US010796678B2

(12) United States Patent
Ichiki

(10) Patent No.: US 10,796,678 B2
(45) Date of Patent: Oct. 6, 2020

(54) KEYBOARD APPARATUS

(71) Applicant: YAMAHA CORPORATION, Hamamatsu-shi (JP)

(72) Inventor: Shunsuke Ichiki, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/477,590

(22) PCT Filed: Jan. 10, 2018

(86) PCT No.: PCT/JP2018/000322
§ 371 (c)(1),
(2) Date: Jul. 12, 2019

(87) PCT Pub. No.: WO2018/131599
PCT Pub. Date: Jul. 19, 2018

(65) Prior Publication Data

US 2020/0005750 A1 Jan. 2, 2020

(30) Foreign Application Priority Data

Jan. 13, 2017 (JP) ..... 2017-004357

(51) Int. Cl.
*G10H 1/32* (2006.01)
*G10H 1/34* (2006.01)
*G10C 3/12* (2006.01)

(52) U.S. Cl.
CPC ..... *G10H 1/346* (2013.01); *G10C 3/12* (2013.01); *G10H 2220/221* (2013.01)

(58) Field of Classification Search
CPC ..... G10H 1/346; G10H 2220/221; G10C 3/12
(Continued)

(56) References Cited

U.S. PATENT DOCUMENTS 3,708,605 A * 1/1973 Ohno ..... G10H 1/0555 84/688
4,892,024 A * 1/1990 Watanabe ..... G10H 1/344 84/423 R (Continued)

FOREIGN PATENT DOCUMENTS

JP S5421715 A 2/1979
JP S5426919 U 2/1979

(Continued)

OTHER PUBLICATIONS

English translation of Written Opinion issued in Intl. Appln. No. PCT/JP2018/000322 dated Mar. 20, 2018, previously cited in IDS filed Jul. 12, 2019.

(Continued)

*Primary Examiner* — Jianchun Qin
(74) *Attorney, Agent, or Firm* — Rossi, Kimms & McDowell LLP

(57) ABSTRACT

A keyboard apparatus includes a key, a frame arranged below the key, a key-side supporting section connected to a member a positional relationship of which is fixed to the key and extending more downward than the member, and a flexible section supported by the key-side supporting section, having flexibility in at least an up-and-down direction, and configured to rotate the key with respect to the frame.

16 Claims, 17 Drawing Sheets

(58) Field of Classification Search
USPC ..... 84/644
See application file for complete search history.

(56) References Cited

U.S. PATENT DOCUMENTS

| | | | | |
|---|---|---|---|---|
| 7,485,798 | B2 * | 2/2009 | Nishida | G10C 3/12 84/18 |
| 8,119,895 | B2 | 2/2012 | Kitajima | |
| 2019/0027121 | A1 | 1/2019 | Ichiki et al. | |

FOREIGN PATENT DOCUMENTS

| | | | |
|---|---|---|---|
| JP | S5616191 | U | 2/1981 |
| JP | S56156092 | U | 11/1981 |
| JP | S62127795 | A | 6/1987 |
| JP | H0335596 | U | 4/1991 |
| JP | H10116066 | A | 5/1998 |
| JP | 2002073029 | A | 3/2002 |
| JP | 2008191650 | A | 8/2008 |
| JP | 2010286696 | A | 12/2010 |
| JP | 2011017904 | A | 1/2011 |
| JP | 2011227273 | A | 11/2011 |
| JP | 2016080859 | A | 5/2016 |
| WO | 2017164296 | A1 | 9/2017 |

OTHER PUBLICATIONS

English translation of Written Opinion issued in Intl. Appln. No. PCT/JP2018/000319 dated Mar. 20, 2018, previously cited in IDS filed Jul. 12, 2019.

International Preliminary Report on Patentability issued in Intl. Appln. No. PCT/JP2018/000331 dated May 7, 2019. English translation provided.

International Search Report issued in Intl. Appln. No. PCT/JP2018/000322 dated Mar. 20, 2018. English translation provided.

Written Opinion issued in Intl. Appln. No. PCT/JP2018/000322 dated Mar. 20, 2018.

International Search Report issued in Intl. Appln. No. PCT/JP2018/000319 dated Mar. 20, 2018. English translation provided.

Written Opinion issued in Intl. Appln. No. PCT/JP2018/000319 dated Mar. 20, 2018.

International Search Report issued in Intl. Appln. No. PCT/JP2018/000331 dated Mar. 20, 2018. English translation provided.

Written Opinion issued in Intl. Appln. No. PCT/JP2018/000331 dated Mar. 20, 2018. Partial Mechanical English Translation provided.

International Preliminary Report on Patentability issued in Intl. Appln. No. PCT/JP2018/000331 dated May 14, 2019.

International Search Report issued in Intl. Appln. No. PCT/JP2018/017343 dated Jul. 10, 2018.

Written Opinion issued in Intl. Appln. No. PCT/JP2018/017343 dated Jul. 10, 2018. Partial Mechanical English Translation provided.

Copending U.S. Appl. No. 16/509,654, filed Jul. 12, 2019 (a copy is not included because the cited application is not yet available to the public and the Examiner has ready access to the cited application).

* cited by examiner

KEYBOARD APPARATUS

CROSS-REFERENCE TO RELATED APPLICATIONS

This application is a National Stage application of International Application No. PCT/JP2018/000322, filed on Jan. 10, 2018, which claims priority to Japanese Patent Application No. 2017-004357, filed on Jan. 13, 2017, the entire disclosures of each of the applications cited in this paragraph is hereby incorporated herein by reference.

FIELD

The present invention relates to a keyboard apparatus.

BACKGROUND

An example of a structure for rotating keys in an electronic keyboard apparatus is a structure in which a thin plate having flexibility is horizontally arranged (e.g., Japanese Patent Application Laid-Open No. 2008-191650). When the thin plate is bent and deformed, the keys can be rotated in an up-and-down direction. Japanese Patent Application Laid-Open No. 2008-191650 further discloses a structure capable of permitting movement in a direction in which the keys are arranged by further using a thin plate vertically arranged together and connecting the thin plate vertically arranged in series with the thin plate horizontally arranged.

SUMMARY

According to an aspect of the present invention, there is provided a keyboard apparatus including a key, a frame arranged below the key, a key-side supporting section connected to a member a positional relationship of which is fixed to the key and extending more downward than the member, and a flexible section supported by the key-side supporting section, having flexibility in at least an up-and-down direction, and configured to rotate the key with respect to the frame.

DESCRIPTION OF EMBODIMENTS

Figure 1:
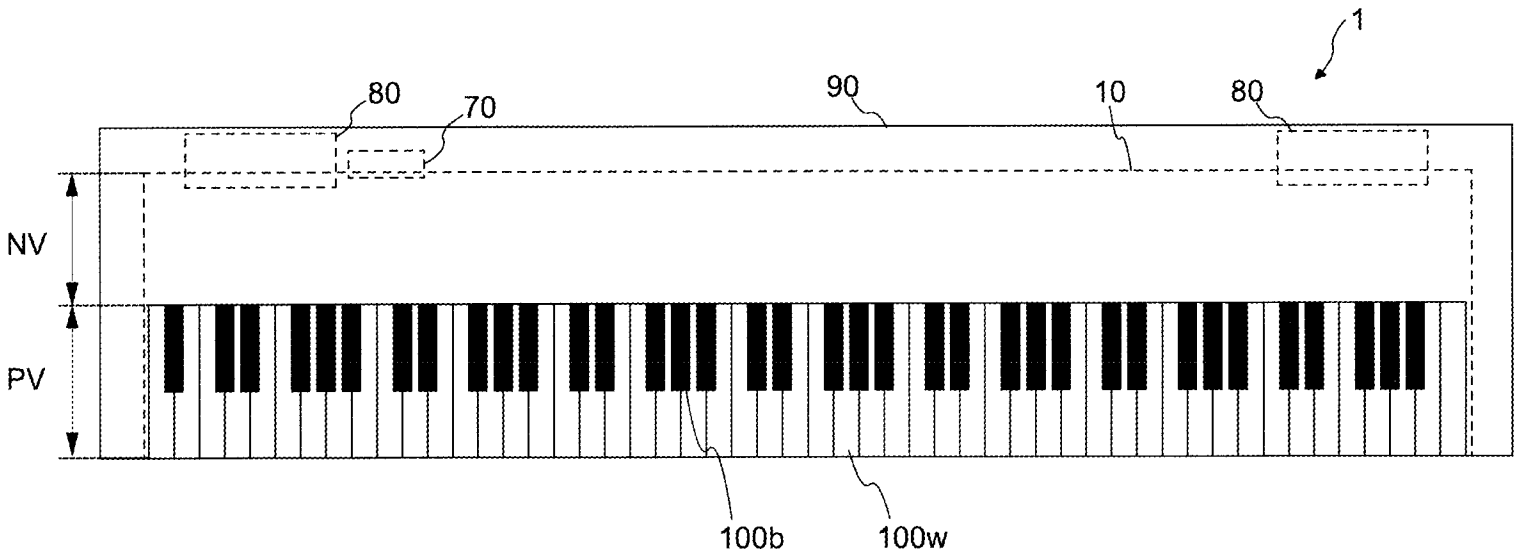
FIG. 1 is a diagram illustrating a configuration of a keyboard apparatus according to a first embodiment.

A keyboard apparatus according to an embodiment of the present invention will be described in detail below with reference to the drawings. Embodiments described below are examples of the embodiment of the present invention, and the present invention is not necessarily limited to the embodiments and interpreted. In the drawings referred to in the present embodiment, identical sections or sections having similar functions are respectively assigned identical or similar reference symbols (reference numerals followed by A, B, etc.), and repetitive description may be omitted. A dimensional ratio (a ratio among components, a ratio between vertical and horizontal height directions, etc.) in the drawings may differ from an actual ratio for convenience of illustration, or some of the components may be omitted from the drawings.

A touch feeling of keys in an acoustic piano is desirably reproduced by an electronic keyboard instrument. The touch feeling means a predetermined feeling given to fingers of a player through the keys at the time of key depression. The touch feeling obtained by the acoustic piano is implemented by a combination of various elements such as an operation of an action mechanism. According to the structure disclosed in Japanese Patent Application Laid-Open No. 2008-191650, a rotation center of the key is arranged at a rear end of the key. On the other hand, in the acoustic piano, the key is rotatably supported by a balance pin, and a rotation center of the key is positioned on the side of a lower surface of the key. That is, the rotation center of the key in Japanese Patent Application Laid-Open No. 2008-191650 is arranged at a position on the side closer to a surface of the key, as compared to the rotation center of the key in the acoustic piano. Such a difference in position between the rotation centers is a factor preventing the touch feeling obtained by the acoustic piano from being obtained by the electronic keyboard instrument.

A keyboard apparatus according to an embodiment described below can implement a touch feeling close to that implemented by the acoustic piano using a structure different from a structure of the acoustic piano.

First Embodiment

[Configuration of Keyboard Apparatus]

FIG. 1 is a diagram illustrating a configuration of a keyboard apparatus according to a first embodiment. A keyboard apparatus 1 is an electronic keyboard instrument which produces a sound in response to key depression by a user (player) of an electronic piano or the like. The keyboard apparatus 1 may be a keyboard-type controller which outputs control data (e.g., MIDI (musical instrument digital interface)) for controlling a sound source device outside thereof in response to key depression. In this case, the keyboard apparatus 1 may not include a sound source device.

The keyboard apparatus 1 includes a keyboard assembly 10. The keyboard assembly 10 includes white keys 100*w* and black keys 100*b*. The plurality of white keys 100*w* and the plurality of black keys 100*b* are arranged side by side. Although the number of keys 100 is N (88 in this example), the number of keys 100 is not limited to the number. A direction in which the keys 100 are arranged is referred to as a scale direction. The white key 100*w* and the black key 100*b* may be referred to as the key 100 when they can be described without being particularly distinguished. In the following description, a component with "w" at the end of a reference numeral means a component corresponding to the white key 100*w*. A component with "b" at the end of a reference numeral means a component corresponding to the black key 100*b*.

A part of the keyboard assembly 10 exists within a housing 90. When the keyboard apparatus 1 is viewed from above, a section, which is covered with the housing 90, of the keyboard assembly 10 is referred to as a non-appearance section NV, and a section, which is exposed from the housing 90 and is visually recognizable from a user, of the keyboard assembly 10 is referred to as an appearance section PV. That is, the appearance section PV represents a region which is a part of the key 100 and can perform a performance operation by the user. A section, which is exposed by the appearance section PV, of the key 100 may be referred to as a key body section.

A sound source device 70 and a speaker 80 are arranged within the housing 90. The sound source device 70 generates a sound waveform signal as the key 100 is depressed. The speaker 80 outputs the sound waveform signal generated by the sound source device 70 to an external space. The keyboard apparatus 1 may include a slider for controlling a sound volume, a switch for switching a tone, a display for displaying various types information, and the like.

In the description in the present specification, upward, downward, leftward, rightward, forward, and backward directions respectively indicate directions in a case where the keyboard apparatus 1 is viewed from the player when the player performs a performance. Accordingly, the non-appearance section NV can be represented as being positioned on the deeper side than the appearance section PV, for example. A direction may be indicated with the key 100 used as a reference, for example, a key front end side (key front side) and a key rear end side (key back side). In this case, the key front end side represents the front side of the key 100 viewed from the player. The key rear end side represents the deeper side of the key 100 viewed from the player. Such a definition can indicate that a portion, from a front end to a rear end of the key body section of the black key 100*b*, of the black key 100*b* is a portion protruding more upward than the white key 100*w*.

Figure 2:
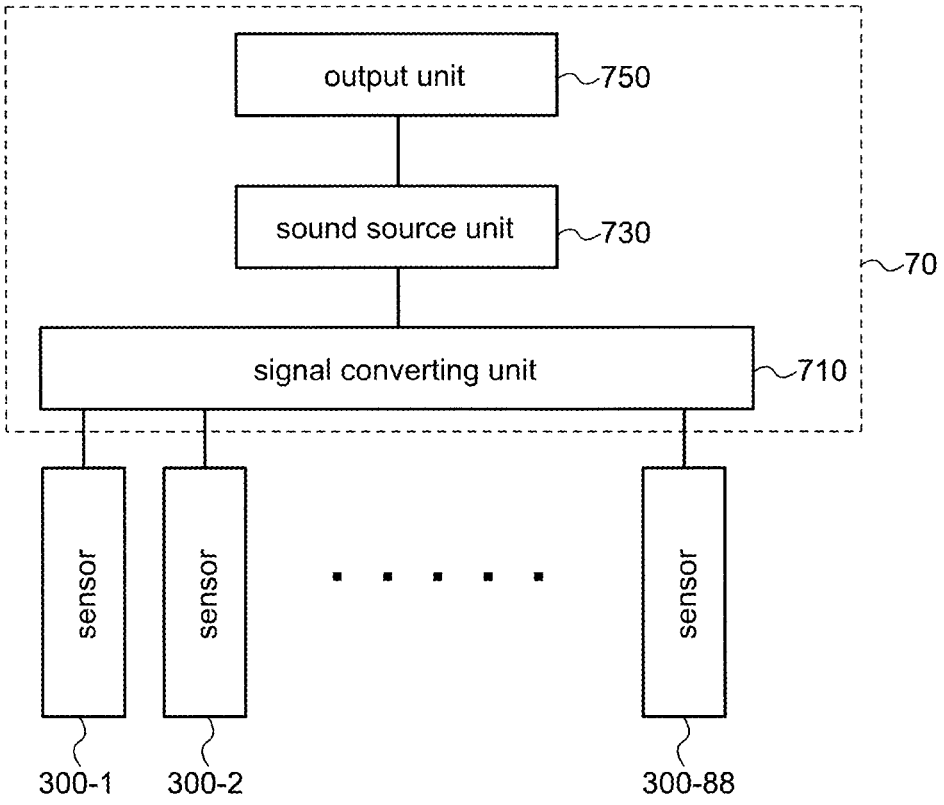
FIG. 2 is a block diagram illustrating a configuration of a sound source device in the first embodiment.

FIG. 2 is a block diagram illustrating a configuration of the sound source device 70 according to the first embodiment. The sound source device 70 includes a signal converting section 710, a sound source unit 730, and an operation unit 750. A sensor 300 is provided to correspond to each of the keys 100, and detects an operation of the key 100 and outputs a signal corresponding to a detected content. In this example, the sensor 300 outputs signals respectively depending on key depression amounts in three stages. A key depression speed can be detected depending on an interval between the signals.

The signal converting unit 710 acquires an output signal of a sensor 300 (sensors 300-1, 300-2, . . . , 300-88 corresponding to the 88 keys 100), and generates and outputs an operation signal corresponding to an operation state in each of the keys 100. In this example, the operation signal is a signal in an MIDI format. Accordingly, the signal converting unit 710 outputs "note on" in response to a key depression operation. At this time, "key number" indicating which of the 88 keys 100 has been operated and "velocity" corresponding to the key depression speed are also outputted in association with "note on". On the other hand, the signal converting unit 710 outputs "key number" and "note off" in association with each other in response to a key release operation. The signal converting unit 710 may receive a signal corresponding to another operation of a pedal or the like and may be reflected on the operation signal.

The sound source unit 730 generates a sound waveform signal based on the operation signal outputted from the signal converting unit 710. The output unit 750 outputs the sound waveform signal generated by the sound source unit 730. The sound waveform signal is outputted to the speaker 80 or a sound waveform signal output terminal, for example.

[Configuration of Keyboard Assembly]

Figure 3:
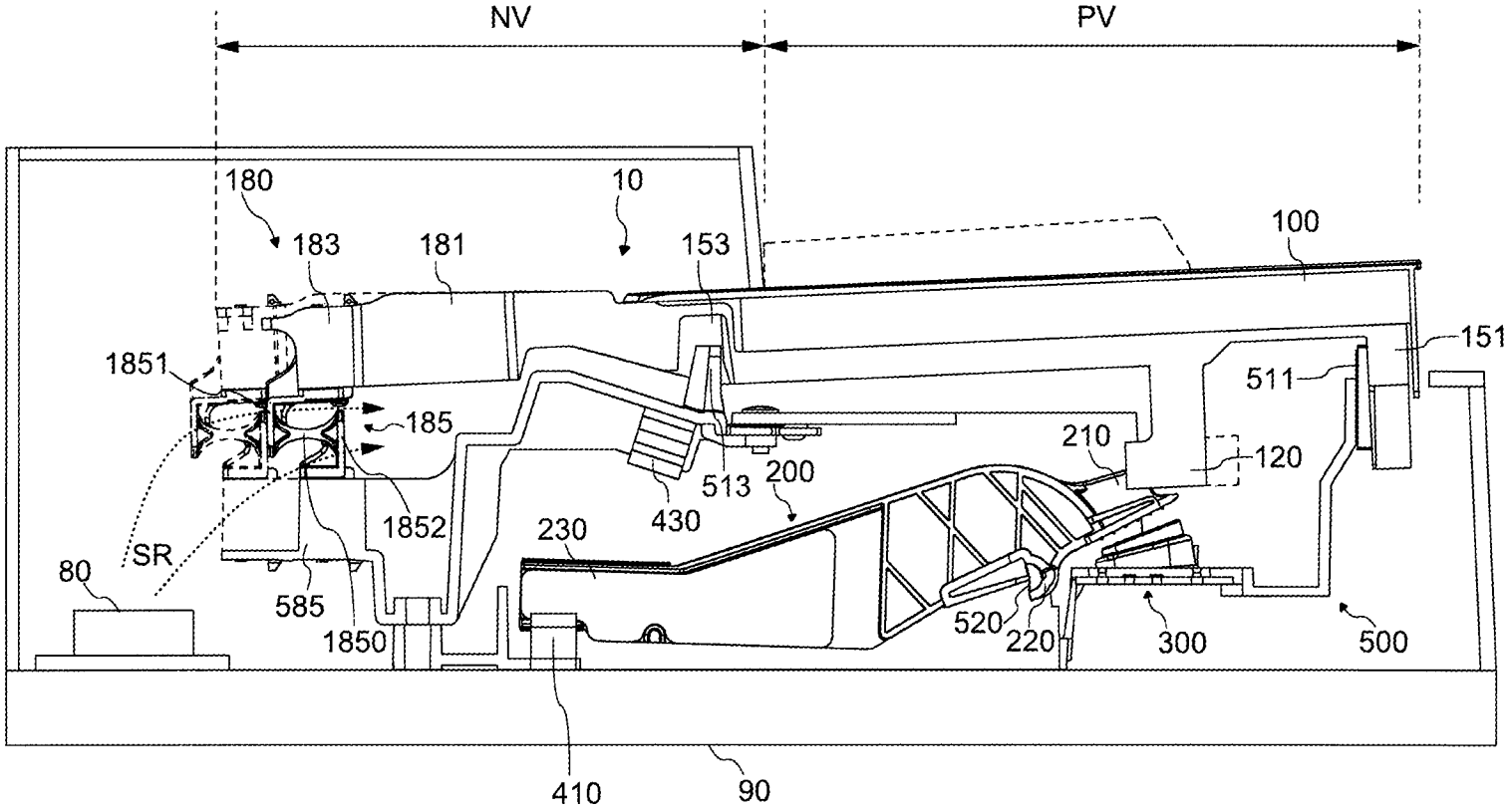
FIG. 3 is an explanatory diagram in a case where components within a housing are viewed from the side in the first embodiment.

FIG. 3 is an explanatory diagram in a case where components within the housing 90 are viewed from the side in the first embodiment. As illustrated in FIG. 3, the keyboard assembly 10 and the speaker 80 are arranged within the housing 90. That is, the housing 90 covers at least a part of the keyboard assembly 10 (a connecting section 180 and a frame 500) and the speaker 80. The speaker 80 is arranged on the deeper side of the keyboard assembly 10. The speaker 80 is arranged to output sounds corresponding to key depression, respectively, toward the top and the bottom of the housing 90. The sound outputted downward proceeds outward from a lower surface side of the housing 90. On the other hand, the sound outputted upward passes through a space within the keyboard assembly 10 from within the housing 90 and proceeds outward from a gap between the adjacent keys 100 in the appearance section PV or a gap between the key 100 and the housing 90. A path of the sound from the speaker 80 is illustrated as an example of a path SR. Thus, the sound from the speaker 80 reaches a space within the keyboard assembly 10, i.e., a space below the key 100 (the key body section).

A configuration of the keyboard assembly 10 will be described with reference to FIG. 3. The keyboard assembly 10 includes the connecting section 180, a hammer assembly 200, and the frame 500 in addition to the above-described key 100. The keyboard assembly 10 is a structure made of resin including components almost all of which are manufactured by injection molding. The frame 500 is fixed to the housing 90. The connecting section 180 rotatably connects the key 100 to the frame 500. The connecting section 180 includes a plate-like flexible member 181, a first supporting section 183, and a rotating section 185. Accordingly, the connecting section 180 may include a member which moves integrally with the key 100, and may further include a member which moves integrally with the frame 500. The plate-like flexible member 181 extends from a rear end of the key 100. The first supporting section 183 extends from a rear end of the plate-like flexible member 181.

The rotating section 185 includes a rod-like flexible member 1850, a key-side supporting section 1851, and a frame-side supporting section 1852. The key-side supporting section 1851 and the frame-side supporting section 1852 respectively support both ends in a longitudinal direction of the rod-like flexible member 1850. In this example, the key-side supporting section 1851 is connected to a member (the first supporting section 183) a positional relationship of which is fixed to the key 100, includes a member (a supporting plate 18511, described below) extending more downward than the member (the first supporting section 183), and supports the deeper side of the rod-like flexible member 1850. On the other hand, the frame-side supporting section 1852 supports the front side of the rod-like flexible member 1850. That is, the frame-side supporting section 1852 is arranged on the side closer to the front end of the key 100 than the key-side supporting section 1851. As a result, the rod-like flexible member 1850 is arranged below the key 100, i.e., on the side of the frame 500. The longitudinal direction (an extension direction) of the rod-like flexible member 1850 may hereinafter be referred to as a main axis direction.

The rod-like flexible member 1850 has flexibility in a direction perpendicular to the main axis direction. On the other hand, each of the key-side supporting section 1851 and the frame-side supporting section 1852 is made of the same material as that for the rod-like flexible member 1850, but is in a shape having a higher rigidity than that of the rod-like flexible member 1850. A positional relationship between the key-side supporting section 1851 and the frame-side supporting section 1852 changes depending on a bending deformation of the rod-like flexible member 1850. In this example, the main axis direction of the rod-like flexible member 1850 is substantially along a front-to-back direction of the key 100. Accordingly, when the rod-like flexible member 1850 is bent in an up-and-down direction, the key-side supporting section 1851 moves upward with respect to the frame-side supporting section 1852 so that the key 100 can rotate with respect to the frame 500 (see FIG. 14). A detailed configuration of the rotating section 185 will be described below.

The rotating section 185 is supported by the first supporting section 183 and a second supporting section 585 in the frame 500. At this time, the first supporting section 183 and the key-side supporting section 1851 are detachably connected to each other, and the second supporting section 585 and the frame-side supporting section 1852 are detachably connected to each other. When the rotating section 185 is configured to be detachably attached, ease of manufacture is improved (mold design is facilitated, assembling work is facilitated, repair work is facilitated, etc.), and a touch feeling and a strength are improved by combining respective materials for the sections.

The plate-like flexible member 181 and the first supporting section 183 may be molded integrally with the key 100, and may be made of the same material. Although the frame 500 is also made of the same material as that of the plate-like flexible member 181, at least a part of the frame 500 may include a different material from the material. On the other hand, the rotating section 185 (the rod-like flexible member 1850) and the plate-like flexible member 181 may be made of the same material, although respectively made of different materials. In this example, the plate-like flexible member 181 is more rigid than the rod-like flexible member 1850.

According to the configuration, the plate-like flexible member 181 and the rod-like flexible member 1850, which are connected in series, can also be said to be arranged between the key 100 and the frame 500. Further, in other words, the plate-like flexible member 181 is arranged between the key 100 and the rod-like flexible member 1850. The rod-like flexible member 1850 is arranged between the plate-like flexible member 181 and the frame 500.

The key 100 includes a front-end key guide 151 and a side key guide 153. The front-end key guide 151 slidably contacts a front-end frame guide 511 in the frame 500 with the front-end frame guide 511 covered therewith. The front-end key guide 151 contacts the front-end frame guide 511 on both upper and lower sides thereof in the scale direction. The upper side and the lower side of the front-end key guide 151 respectively correspond to an upper key guide 151*u* and a lower key guide 151*d* (see FIG. 6). The side key guide 153 slidably contacts a side frame guide 513 on both sides thereof in the scale direction. In this example, although the side key guide 153 may be arranged in a region corresponding to the non-appearance section NV on a side surface of the key 100 and exists on the side closer to the front end of the key 100 than the connecting section 180 (the plate-like flexible member 181), the side key guide 153 may be arranged in a region corresponding to the appearance section PV.

The hammer assembly 200 is arranged in a space below the key 100, and is rotatably attached to the frame 500. At this time, a bearing section 220 in the hammer assembly 200 and a shaft 520 in the frame 500 slidably contact each other at at least three points. A front end section 210 in the hammer assembly 200 slidably contacts a hammer supporting section 120 substantially in a front-to-back direction in an inner space of the hammer supporting section 120. A sliding portion, i.e., a portion where the front end section 210 and the hammer supporting section 120 contact each other is positioned below the key 100 in the appearance section PV (on the more forward side than the rear end of the key body section).

In the hammer assembly 200, a weight section 230 made of a metal is arranged on the deeper side than the shaft 520. At a normal time (when the key 100 has not been depressed), the weight section 230 remains placed on a lower stopper 410, and the front end section 210 in the hammer assembly 200 pushes the key 100 back. When the key 100 is depressed, the weight section 230 moves upward, to collide with an upper stopper 430. In the hammer assembly 200, the weight section 230 applies a weight to the depressed key 100. The lower stopper 410 and the upper stopper 430 are formed of a cushioning material or the like (such as a non-woven fabric or an elastic body).

The sensor 300 is attached to the frame 500 below the hammer supporting section 120 and the front end section 210. When the front end section 210 deforms the sensor 300 on its lower surface side by key depression, the sensor 300 outputs a detection signal. The sensor 300 is provided to correspond to each of the keys 100, as described above.

Figure 4:
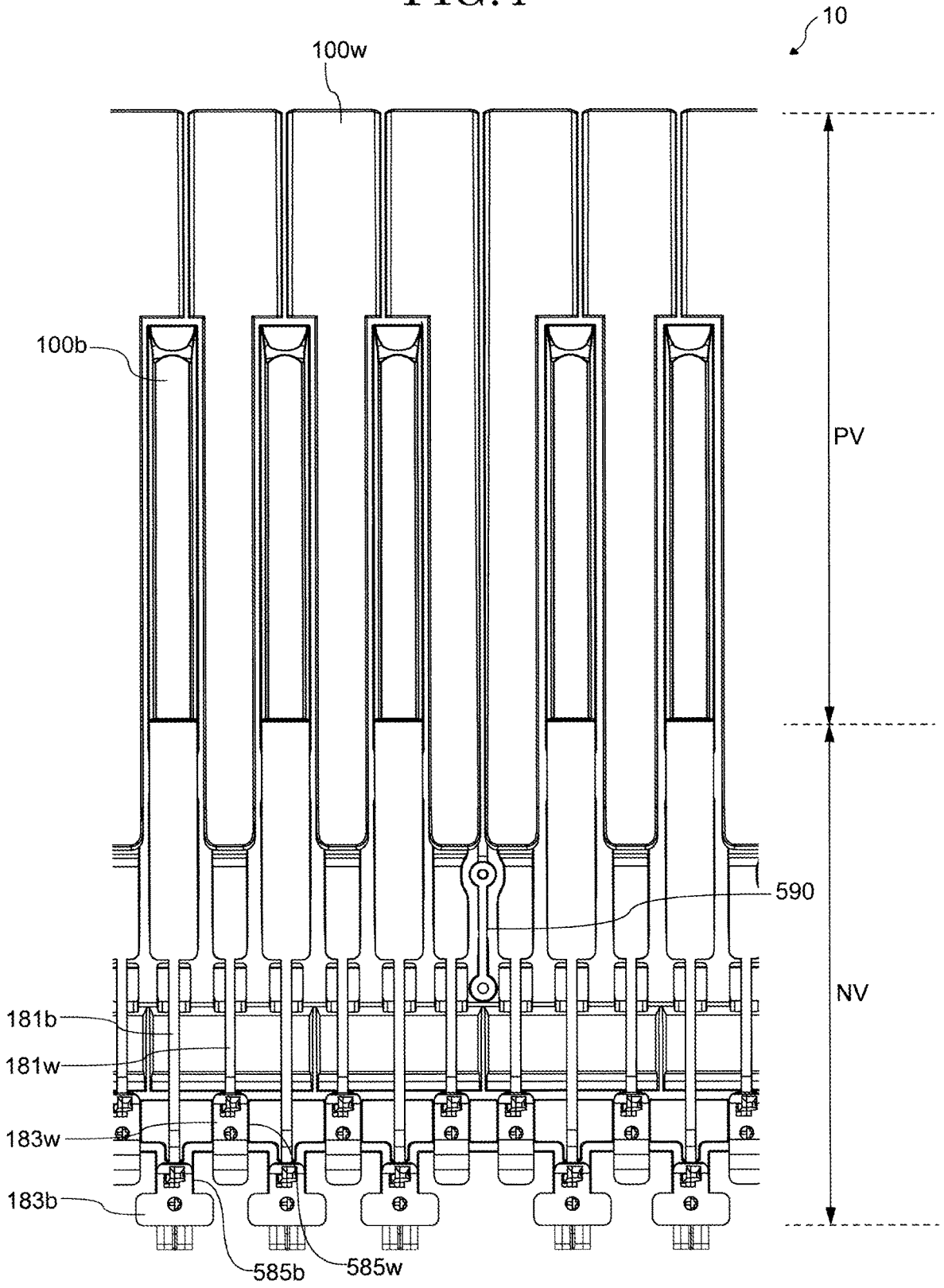
FIG. 4 is an explanatory diagram in a case where a keyboard assembly is viewed from the top in the first embodiment.
Figure 5:
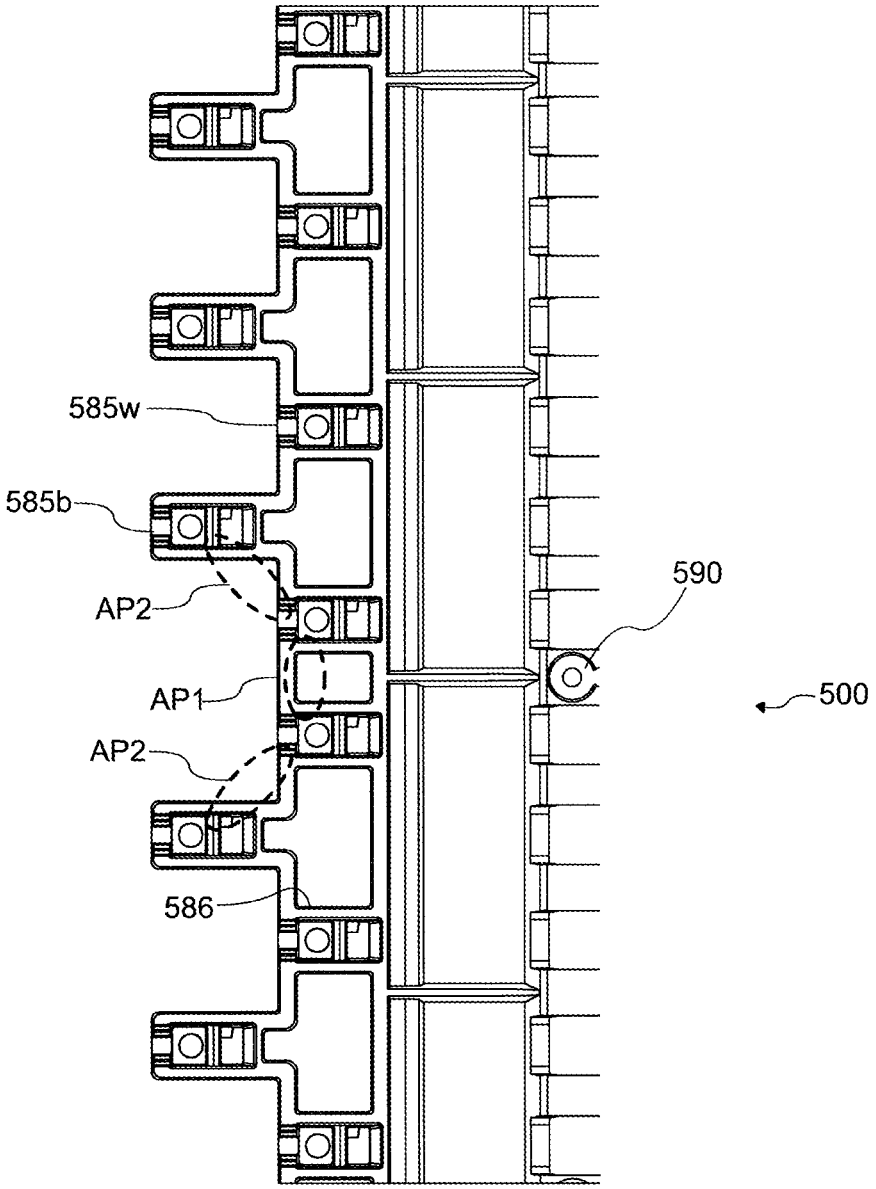
FIG. 5 is an explanatory diagram in a case where a portion, to which a rotating section is connected, of a frame is viewed from the top in the first embodiment.

FIG. 4 is an explanatory diagram in a case where the keyboard assembly 10 is viewed from the top in the first embodiment. FIG. 5 is an explanatory diagram in a case where a portion, to which the rotating section 185 is connected, in the frame 500 is viewed from the top in the first embodiment. In the drawings, components in the hammer assembly 200 and the frame 500 which are positioned below the key 100 are described by omitting some of the components. More specifically, the components (the second supporting section 585, etc.) in the frame 500 in the vicinity of the connecting section 180 are described, and description of some of the components on the front side are omitted. In the other description, description of some of the components may be omitted at the time of illustration.

As illustrated in FIG. 4, a first supporting section 183*b* is arranged at a position on the deeper side than a first supporting section 183*w*. The position is associated with a position of the rod-like flexible member 1850 to be a rotation center of the key 100. Such an arrangement causes a difference between respective rotation centers of a white key and a black key in an acoustic piano to be reproduced. In this example, a plate-like flexible member 181*b* corresponding to the black key 100*b* is longer than a plate-like flexible member 181*w* corresponding to the white key 100*w*. A second supporting section 585*b* in the frame 500 is arranged on the deeper side than a second supporting section 585*w* to correspond to such an arrangement. Accordingly, a shape on the deeper side of the frame 500 (of the second supporting section 585) is a shape in which the second supporting section 585*b* more greatly protrudes than the second supporting section 585*w*, as illustrated in FIG. 5.

Although description of the rotating section 185 is omitted in FIG. 5, a large space exists between the adjacent rotating sections 185, particularly between the adjacent rod-like flexible members 1850. The space corresponds to sound paths AP1 and AP2 illustrated in FIG. 5. A sound outputted from the speaker 80 reaches the inside of the keyboard assembly 10 from the outside of the keyboard assembly 10 after passing through the sound paths AP1 and AP2, and is emitted to the outside of the keyboard apparatus 1 from the gap between the adjacent keys 100. In a path through which the sound passes until it is emitted outward from the appearance section PV, there are few elements for blocking passage of the sound between the frame 500 (the second supporting section 585) and the connecting section 180 (the first supporting section 183) due to the existence of the rod-like flexible member 1850. Thus, an attenuation amount of the sound can also be suppressed. The second supporting section 585*b* is in a shape more protruding than the second supporting section 585*w* so that the sound path AP2 in a portion where the second supporting sections 585*w* and 585*b* are adjacent to each other becomes wider than the sound path AP1 in a portion where the second supporting section 585*w* are adjacent to each other. Further, an opening section 586 may be arranged in a scale direction of the second supporting section 585*w* on the front side of the second supporting section 585*b*. In this case, the opening section 586 can also be a sound path.

A supporting column 590 is a member connected to the housing 90 for fixing a position of frame 500 with respect to the housing 90. The supporting column 590 is provided between the adjacent white keys 100*w* in the non-appearance section NV, i.e., between the white key 100*w* of "E" and the white key 100*w* of "F" and between the white key 100*w* of "B" and the white key 100*w* of "C".

[Structure of White Key]

Figure 6A:
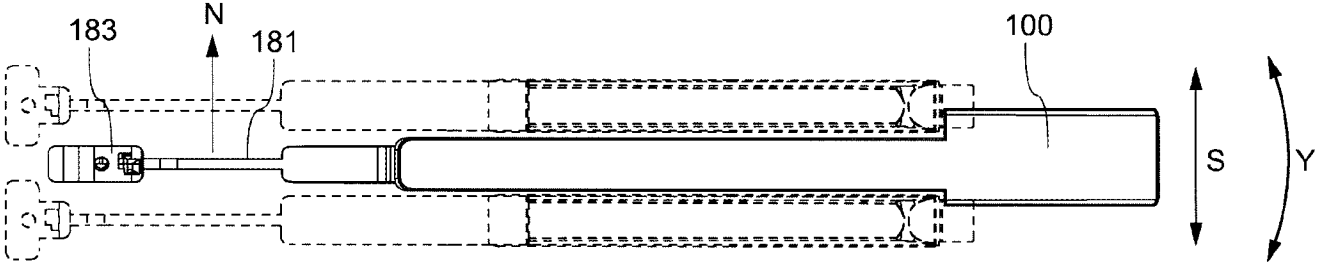
FIG. 6A is a diagram illustrating a detailed structure of a while key in the first embodiment and a diagram of the white key viewed from the top.
Figure 6B:
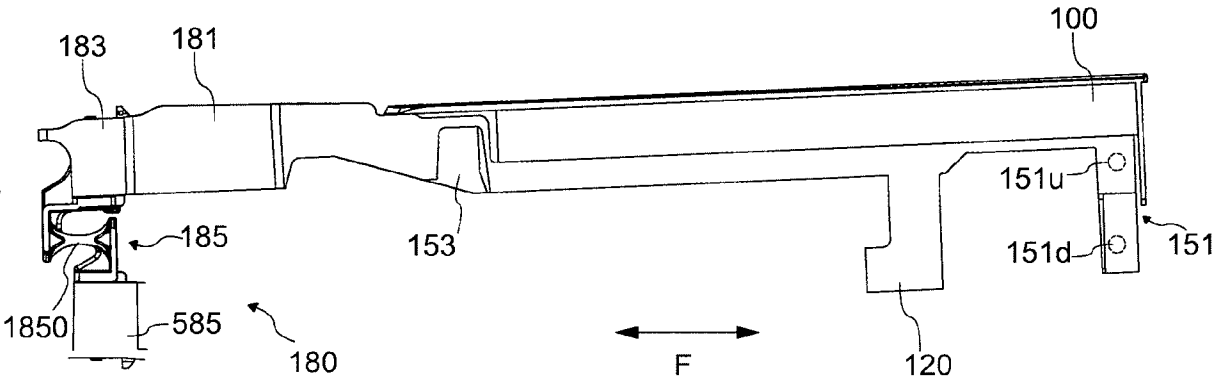
FIG. 6B is a diagram illustrating a detailed structure of the white key in the first embodiment and a diagram of the white key viewed from the side (the left)
Figure 6C:
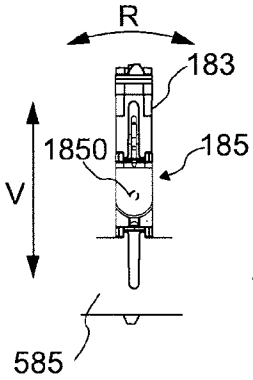
FIG. 6C is a diagram illustrating a detailed structure of the white key in the first embodiment and a diagram of the white key viewed from the back.
Figure 6D:
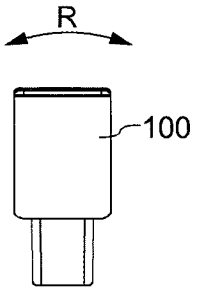
FIG. 6D is a diagram illustrating a detailed structure of the white key in the first embodiment and a diagram of the white key viewed from the front.

FIGS. 6A to 6D are diagrams each illustrating a detailed structure of the white key 100*w* in the first embodiment. FIG. 6A is a diagram illustrating the white key 100*w* viewed from the top. FIG. 6B is a diagram illustrating the white key 100*w* viewed from the side (the left). FIG. 6C is a diagram illustrating the white key 100*w* viewed from the back. FIG. 6D is a diagram illustrating the white key 100*w* from the front.

First, directions (a scale direction S, a rolling direction R, a yawing direction Y, an up-and-down direction V, and a front-to-back direction F) used in the following description will be defined. The scale direction S corresponds to a direction in which the keys 100 are arranged (a right-to-left direction viewed from the player), as described above. The rolling direction R corresponds to a direction in which the key 100 rotates with a direction in which the key 100 extends (a direction to the deeper side from the front viewed from the player) as an axis. The yawing direction Y is a direction in which the key 100 is bent in the right-to-left direction when viewed from the top. Although a difference between the scale direction S and the yawing direction Y is not large, movement in the scale direction S of the key 100 means parallel movement while movement in the yawing direction Y of the key 100 corresponds to bending (warping) in the scale direction S. The up-and-down direction V corresponds to an up-and-down direction viewed from the player, and can also be referred to as a direction to be an axis of bending in the yawing direction Y. The front-to-back direction F corresponds to a direction in which the key 100 extends (a direction to the deeper side from the front viewed from the payer), and can also be referred to as a direction to be an axis of rotation in the rolling direction R. The front-to-back direction F is a direction perpendicular to both the up-and-down direction V and the scale direction S (a direction included in a horizontal plane), and strictly differs from but substantially matches the direction in which the key 100 at a rest position extends. In this example, the rod-like flexible member 1850 extends in the front-to-back direction F. That is, the rod-like flexible member 1850 includes a main axis along the front-to-back direction F.

The key 100 includes the front-end key guide 151 and the side key guide 153. The front-end key guide 151 contacts the front-end frame guide 511 in the frame 500 (see FIG. 3) in its upper and lower parts, as described above. Accordingly, the front-end key guide 151 is actually divided into the upper key guide 151*u* and the lower key guide 151*d*. Thus, the front-end key guide 151 (the upper key guide 151*u* and the lower key guide 151*d*) and the side key guide 153 regulate movement of the key 100 at three portions not arranged on a straight line when the key 100 is viewed in the scale direction S. The guides in at least the three portions thus arranged cause the movement of the key 100 to be regulated in the scale direction S, the yawing direction Y, and the rolling direction R. The number of guides may be three or more. In this case, a requirement that the guides are not arranged on the straight line need not be applied to all the guides but may be applied to the guides in at least the three portions.

The plate-like flexible member 181 is a plate-like member having flexibility in the scale direction S. A normal direction N of a plate surface of the plate-like flexible member 181 is arranged along the scale direction S. As a result, the plate-like flexible member 181 can be deformed in the rolling direction R and the yawing direction Y by being bent or twisted. That is, the plate-like flexible member 181 has a degree of freedom in the rolling direction R and the yawing direction Y of the key 100 due to its flexibility. The plate-like flexible member 181 can also be said to also have a degree of freedom in the scale direction S by combining deformations in the yawing direction Y in a plurality of portions (a state of having inflection points). On the other hand, the plate-like flexible member 181 is hardly deformed in the up-and-down direction V. The normal direction N may not completely match the scale direction S, but may have a component in the scale direction S. If the normal direction N and the scale direction S do not match each other, an angle formed between the normal direction N and the scale direction S is preferably as small as possible.

The rod-like flexible member 1850 is a member having flexibility in a direction perpendicular to the main axis. That is, the rod-like flexible member 1850 is a rod-like member having flexibility in the up-and-down direction V (flexibility within a plane having the scale direction S as a normal line (a pitch direction: a rotation direction at the time of key depression) (being bendable within the plane)) while having flexibility in the scale direction S (flexibility in the yawing direction Y (being bendable in the scale direction S)). The rod-like flexible member 1850 can be deformed in the rolling direction R and the yawing direction Y by being bent or twisted. That is, the rod-like flexible member 1850 has a degree of freedom in the rolling direction R and the yawing direction Y of the key 100 due to the flexibility. The rod-like flexible member 1850 can also be said to also have a degree of freedom in the scale direction S by combining deformations in the yawing direction Y in a plurality of portions (a state of having inflection points). On the other hand, the rod-like flexible member 1850 is hardly deformed in the main axis direction, i.e., the front-to-back direction F. An amount in which the rod-like flexible member 1850 can be twisted is larger than an amount in which the plate-like flexible member 181 can be twisted due to a shape-wise characteristic of the rod-like flexible member 1850.

Thus, the connecting section 180 is hardly displaced in the front-to-back direction F (the rotation center hardly moves in the front-to-back direction F) against a strong force to depress the key 100 on the more backward side (on the deeper side) than the side key guide 153 in the key 100. The connecting section 180 has a structure in which a force in the up-and-down direction V is not easily applied to the rotating section 185 by key depression. Therefore, the connecting section 180 can rotate the key 100 in a pitch direction with respect to the frame 500 while hardly displacing the rotation center in the front-to-back direction F and the up-and-down direction V. At this time, the connecting section 180 can be deformed in the rolling direction R and the yawing direction Y. That is, the connecting section 180 can not only rotate the key 100 with respect to the frame 500 but also be deformed in the rolling direction R and the yawing direction Y. The connecting section 180 has a structure in which movement is regulated in the front-and-back direction F (a force to move the connecting section 180 in the up-and-down direction V is not easily applied) while having a degree of freedom in the rolling direction R and the yawing direction Y of the key 100. The connecting section 180 can also be said to also have a degree of freedom in the scale direction S by combining deformations in the yawing direction Y in a plurality of portions (a state of having inflection points), combining deformations in the yawing direction Y in the plurality of portions and deformations in the rolling direction R in the plurality of portions, or combining deformations in the rolling direction R in the plurality of portions, as described above.

The key 100 may be deformed, including the yawing direction Y and the rolling direction R, due to a manufacturing error and a change with time, as described above. At this time, between the front-end key guide 151 and the side key guide 153, an influence of the deformation of the key 100 is visually recognized as less as possible in the appearance section PV by the regulation using the guides. On the other hand, the influence of the deformation is suppressed in the appearance section PV. Thus, the influence of the deformation is greatly received in the non-appearance section NV. The longer the key 100 is, the more significant the influence becomes.

For example, a first example supposes a case where the key 100 has been deformed (deformed in the rolling direction R) to be gradually twisted. In this case, a direction in the rolling direction R of a front end portion of the key 100 is regulated to be a vertical direction by the upper key guide 151*u* and the lower key guide 151*d*. Thus, the influence of the deformation in the rolling direction R is observed toward the deeper side of the key 100. A second example supposes a case where the key 100 has been deformed (deformed in the yawing direction Y) to be gradually bent in the scale direction S. In this case, a position in the scale direction S of the key 100 in the appearance section PV is regulated by the front-end key guide 151 and the side key guide 153. Thus, the influence of the deformation in the yawing direction Y is observed toward the deeper side of the key 100.

In either one of the cases, respective positions of a portion to be the rotation center of the key 100 and the frame 500 shift from each other due to the influence of the deformation of the key 100. That is, a positional relationship between the connecting section 180 (the first supporting section 183) and the second supporting section 585, which are connected to the key 100, changes.

On the other hand, in the key 100 in the first embodiment, the plate-like flexible member 181 and the rod-like flexible member 1850 can be deformed due to the flexibility. That is, even if respective positions of the key 100 and the second supporting section 585 have shifted from each other, the connecting section 180 (the plate-like flexible member 181 and the rod-like flexible member 1850) can connect the key 100 and the second supporting section 585 to each other due to its own deformation. At this time, the rod-like flexible member 1850 simultaneously has the following two functions. First, the rod-like flexible member 1850 has a function as a member (a flexible portion) for rotating the key 100 in the pitch direction because it can be bent and deformed in the up-and-down direction V while being hardly displaced in the front-to-back direction F with respect to key depression (hardly moving in the front-to-back direction F of the rotation center). Second, the rod-like flexible member 1850 also has a function as a member for absorbing the influence of the deformation of the key 100 by its own deformation.

The influence of the deformation of the key 100 is visually recognized as less as possible in the appearance section PV, as described above. Thus, a positional accuracy in the scale direction S is also high. Accordingly, the front end section 210 in the hammer assembly 200 detected by the sensor 300 and the hammer supporting section 120 in the key 100 connected to the front end section 210 are desirably provided below the key 100 in the appearance section PV (on the more forward side than the rear end of the key body section).

[Configuration of Rotating Section]

In this example, the rotating section 185 is detachably attached to the first supporting section 183 and the second supporting section 585. A configuration of the rotating section 185 will be described.

Figure 7:
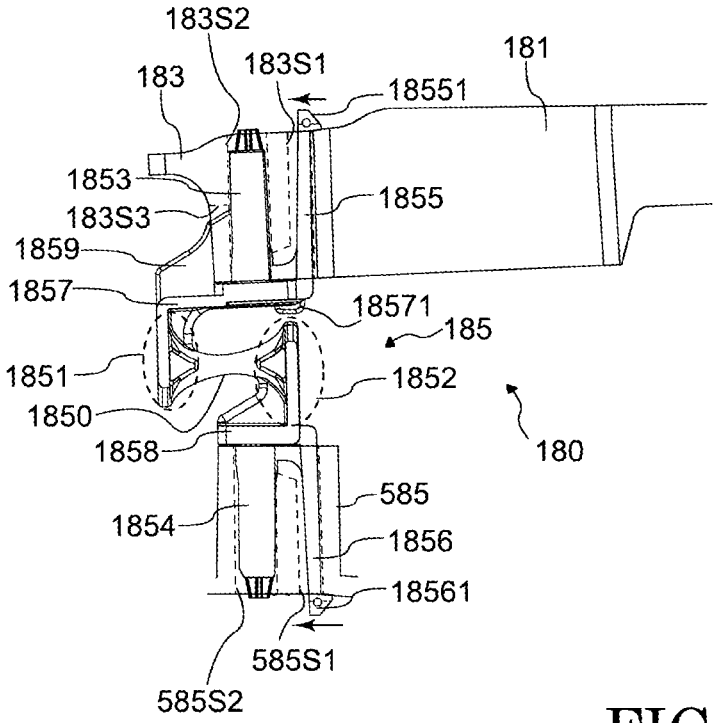
FIG. 7 is a diagram illustrating a structure of a rotating section in the first embodiment.

FIG. 7 is a diagram illustrating a structure of the rotating section 185 in the first embodiment. FIG. 7 is a diagram illustrating the vicinity of the connecting section 180 illustrated in FIG. 6B in an enlarged manner. Components existing within the first supporting section 183 and the second supporting section 585 in the rotating section 185 are also respectively indicated by solid lines. On the other hand, spaces formed within the first supporting section 183 and the second supporting section 585 are respectively indicated by broken lines.

The first supporting section 183 has a first space 183S1 and a second space 183S2, which penetrate therethrough in the up-and-down direction V, formed in its inner part. A third space 183S3 is connected to the rear end side of the second space 183S2. An engaging rod 1855 is arranged in the first space 183S1, and a supporting rod 1853 is arranged in the second space 183S2. The supporting rod 1853 is inserted from below into the second space 183S2. The engaging rod 1855 is inserted from below into the first space 183S1. The engaging rod 1855 includes an engaging section 18551 at its top. The engaging section 18551 protrudes upward from the first space 183S1. The engaging rod 1855 engages with the first supporting section 183 when the engaging section 18551 is caught on an upper surface of the first supporting section 183, not to drop out of the first supporting section 183 in a range in which the key 100 rotates. The engaging rod 1855 has flexibility. At this time, the engaging rod 1855 may be arranged in the first space 183S1 with the engaging rod 1855 bent toward the side of the supporting rod 1853 (the deeper side). When the engaging rod 1855 is bent to move toward the side of the supporting rod 1853 by the engaging section 18551 being pressed toward the side of the supporting rod 1853, the engagement of the engaging rod 1855 with the first supporting section 183 is released.

The supporting rod 1853 and the engaging rod 1855 are connected to a pedestal 1857. The pedestal 1857 is a plate-like member arranged along a lower surface of the first supporting section 183. In this example, a reinforcement plate 1859 for preventing a positional relationship between the supporting rod 1853 and the pedestal 1857 from changing is arranged. The reinforcement plate 1859 is a plate-like member spreading perpendicularly to a surface over which the pedestal 1857 spreads, and a part of the reinforcement plate 1859 is also arranged in the third space 183S3. The pedestal 1857 contacts the first supporting section 183 while the key-side supporting section 1851 is connected to the pedestal 1857 on the deeper side than a region where the pedestal 1857 contacts the first supporting section 183. Accordingly, a portion, which does not contact the first supporting section 183, on the deeper side of the pedestal 1857 easily receives a force in a direction in which the pedestal 1857 is bent at the time of key depression. A deformation of the pedestal 1857 by the force can be suppressed due to the existence of the reinforcement plate 1859.

The pedestal 1857 includes the key-side supporting section 1851 on a surface (lower surface) on the opposite side to a surface (upper surface) on which the supporting rod 1853 and the engaging rod 1855 are arranged. The key-side supporting section 1851 is indirectly connected to the key 100, and extends downward (toward the side of the frame 500) with respect to the member (the first supporting section 183) the positional relationship of which is fixed to the key 100. That is, the key-side supporting section 1851 has its positional relationship fixed to the key 100, and is arranged on the side closer to the frame 500 (more specifically, the second supporting section 585) than the key 100 (more specifically, the first supporting section 183).

The second supporting section 585 has a first space 585S1 and a second space 585S2, which penetrate therethrough in the up-and-down direction V, formed in its inner part. An engaging rod 1856 is arranged in the first space 585S1, and a supporting rod 1854 is arranged in the second space 585S2. The supporting rod 1854 is inserted from above into the second space 585S2. The engaging rod 1856 is inserted from above into the first space 585S1. The engaging rod 1856 includes an engaging section 18561 at its top. The engaging section 18561 protrudes downward from the first space 585S1. The engaging rod 1856 engages with the second supporting section 585 when the engaging section 18561 is caught on a lower surface of the second supporting section 585, not to drop out of the second supporting section 585 in a range in which the key 100 rotates. The engaging rod 1856 has flexibility. At this time, the engaging rod 1856 may be arranged in the first space 585S1 with the engaging rod 1856 bent toward the side of the supporting rod 1854 (the deeper side). When the engaging rod 1856 is bent to move toward the side of the supporting rod 1854 by the engaging section 18561 being pressed toward the side of the supporting rod 1854, the engagement of the engaging rod 1856 with the second supporting section 585 is released.

The supporting rod 1854 and the engaging rod 1856 are connected to a pedestal 1858. The pedestal 1858 is a plate-like member arranged along an upper surface of the second supporting section 585. The pedestal 1858 includes the frame-side supporting section 1852 on a surface (upper surface) on the opposite side to a surface (lower surface) on which the supporting rod 1854 and the engaging rod 1856 are arranged. The frame-side supporting section 1852 is indirectly connected to the frame 500, and extends upward (toward the side of the key 100) with respect to the frame 500. That is, the frame-side supporting section 1852 has its positional relationship fixed to the frame 500, and is arranged on the side closer to the key 100 (more specifically, the first supporting section 183) than the frame 500 (more specifically, the second supporting section 585).

As described above, the rod-like flexible member 1850 has its both ends connected to the key-side supporting section 1851 and the frame-side supporting section 1852. A detailed configuration of the rod-like flexible member 1850, the key-side supporting section 1851, and the frame-side supporting section 1852 will be described below. In this example, the key-side supporting section 1851 and the frame-side supporting section 1852 are arranged to oppose each other so that the longitudinal direction (main axis direction) of the rod-like flexible member 1850 is arranged along the front-to-back direction F. The frame-side supporting section 1852 is arranged on the side closer to the front end (the front) of the key 100 than the key-side supporting section 1851.

A key-side interference section 18571 is connected to the pedestal 1857 at a position opposing the frame-side supporting section 1852. The key-side interference section 18571 is arranged with its positional relationship fixed to the key-side supporting section 1851 via the pedestal 1857. The rod-like flexible member 1850 is bent in the up-and-down direction V so that the key-side interference section 18571 and the frame-side supporting section 1852 contact each other. The key-side interference section 18571 and the frame-side supporting section 1852 are spaced away from each other to such a degree that they do not contact each other in a range in which the rod-like flexible member 1850 is bent by depression of the key 100. That is, a positional relationship between the key-side interference section 18571 and the frame-side supporting section 1852 is determined such that the key-side interference section 18571 and the frame-side supporting section 1852 contact each other outside a movable range of the key 100 and in a flexible range of the rod-like flexible member 1850.

[Method for Detachably Attaching Rotating Section]

Then, a method for detaching the rotating section 185 from the first supporting section 183 and the second supporting section 585 will be described.

Figure 8:
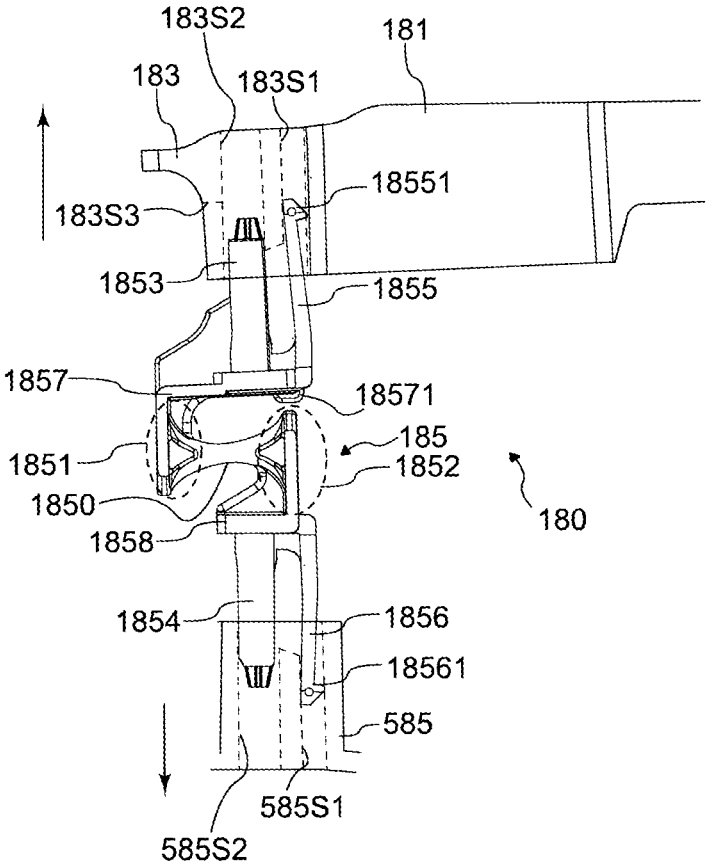
FIG. 8 is a diagram illustrating a method for detaching the rotating section from another member in the first embodiment.
Figure 9A:
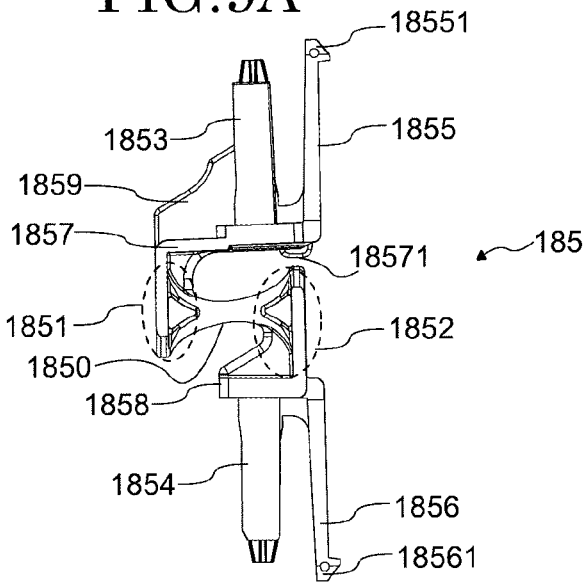
FIG. 9A is a diagram illustrating a structure in which the rotating section has been detached from the other member in the first embodiment and is a diagram in a case where the rotating section has been completely detached from a first supporting section and a second supporting section.
Figure 9B:
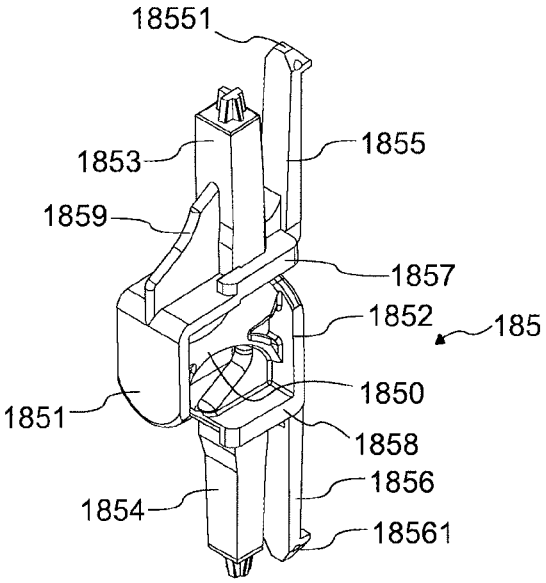
FIG. 9B is a diagram illustrating a structure in which the rotating section has been detached from the other member in the first embodiment and a perspective view of the rotating section viewed in another direction.
Figure 9C:
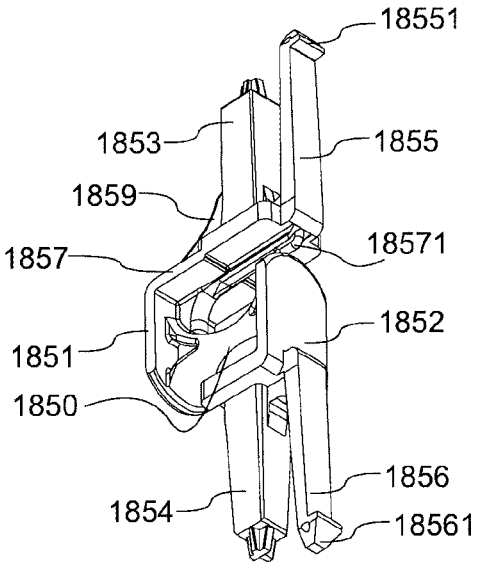
FIG. 9C is a diagram illustrating a structure in which the rotating section has been detached from the other member in the first embodiment and a perspective view of the rotating section viewed in another direction.

FIG. 8 is a diagram illustrating a method for detaching the rotating section 185 from another member in the first embodiment. A method for detaching the rotating section 185 from the first supporting section 183 will be described. FIGS. 9A to 9C are diagrams each illustrating a structure in which the rotating section 185 has been detached from another member in the first embodiment. More specifically, FIG. 8 is a diagram illustrating a stage in which the rotating section 185 is being detached from the first supporting section 183 and the second supporting section 585. FIG. 9A is a diagram in a case where the rotating section 185 has been completely detached from the first supporting section 183 and the second supporting section 585. As FIGS. 9B and 9C, perspective views of the rotating section 185 respectively viewed in other directions are described as a reference.

When a force is applied toward the side of the supporting rod 1853 to the engaging section 18551, the engaging rod 1855 having flexibility is bent so that the engaging section 18551 moves to a position where it can pass through the first space 183S1. When the first supporting section 183 is moved upward with respect to the rotating section 185, the engaging section 18551 passes through the first space 183S1, as illustrated in FIG. 8. Further, when the first supporting section 183 is moved upward, the first supporting section 183 and the rotating section 185 are separated from each other so that a shape of the engaging rod 1855 is returned to its original shape, as illustrated in FIG. 9A.

On the other hand, when the rotating section 185 is attached to the first supporting section 183, the first supporting section 183 is moved downward with the supporting rod 1853 inserted from below into the second space 183S2 and the engaging section 18551 inserted from below into the first space 183S1. At this time, a shape of a distal end of the engaging section 18551 has an inclined surface, whereby the engaging section 18551 and the engaging rod 1855 are inserted into the first space 183S1 while the engaging rod 1855 is bent toward the side of the supporting rod 1853 (FIG. 8). Further, when the first supporting section 183 is moved downward, the engaging section 18551 protrudes upward from the first space 183S1, the shape of the engaging rod 1855 is returned to the original shape, and the engaging section 18551 engages with the upper surface of the first supporting section 183. Accordingly, the first supporting section 183 and the engaging rod 1855 may also be said to be respectively connectors for detachably connecting the plate-like flexible member 181 and the rotating section 185 to each other.

Then, a method for detaching the rotating section 185 from the second supporting section 585 will be described. Basically, the same is true for a case where the rotating section 185 is detached from the first supporting section 183. When a force is applied toward the side of the supporting rod 1854 to the engaging section 18561, the engaging rod 1856 having flexibility is bent so that the engaging section 18561 moves to a position where it can pass through the first space 585S1. When the second supporting section 585 is moved downward with respect to the rotating section 185, the engaging section 18561 passes through the first space 585S1, as illustrated in FIG. 8. Further, when the second supporting section 585 is moved downward (when the rotating section 185 is moved upward), the second supporting section 585 and the rotating section 185 are separated from each other so that a shape of the engaging rod 1856 is returned to its original shape, as illustrated in FIG. 9A.

On the other hand, when the rotating section 185 is attached to the second supporting section 585, the second supporting section 585 is moved upward (the rotating section 185 is moved downward) while the supporting rod 1854 is inserted from above into the second space 585S2 and the engaging section 18561 is inserted from above into the first space 585S1. At this time, a shape of a distal end of the engaging section 18561 has an inclined surface, whereby the engaging section 18561 and the engaging rod 1856 are inserted into the first space 585S1 while the engaging rod 1856 is bent toward the side of the supporting rod 1854 (FIG. 8). Further, when the second supporting section 585 is moved upward (when the rotating section 185 is moved downward), the engaging section 18561 protrudes downward from the first space 585S1, the shape of the engaging rod 1856 is returned to the original shape, and the engaging section 18561 engages with the lower surface of the second supporting section 585. Accordingly, the second supporting section 585 and the engaging rod 1856 may also be said to be respectively connectors for detachably connecting the frame 500 (see FIG. 3) and the rotating section 185 to each other.

FIG. 8 illustrates a stage in which the rotating section 185 is being detached from both the first supporting section 183 and the second supporting section 585, both the first supporting section 183 and the second supporting section 585 need not be simultaneously detached. Either one of the first supporting section 183 and the second supporting section 585 may be first detached from the rotating section 185.

When the rotating section 185 is attached to the first supporting section 183 and the second supporting section 585, pressure is applied in the up-and-down direction V to the rod-like flexible member 1850. At this time, the pressure is applied such that the pedestal 1857 and the pedestal 1858 come closer to each other. As a result, a force is applied such that the key-side supporting section 1851 moves downward and the frame-side supporting section 1852 moves upward. Thus, the pressure is exerted to deform the rod-like flexible member 1850. As this deformation, there occurs a deformation (bends in the up-and-down direction V in a plurality of portions, i.e., a state of having inflection points) different from the deformation by rotation of the key 100. Therefore, such a deformation desirably occurs as less as possible. At this time, when the rod-like flexible member 1850 is deformed until the key-side interference section 18571 and the frame-side supporting section 1852 (more specifically, the supporting plate 18521 illustrated in FIG. 10) contact each other, the pedestal 1857 and the pedestal 1858 cannot come any closer to each other. Therefore, the deformation of the rod-like flexible member 1850 can be inhibited from increasing. Although the key-side interference section 18571 does not contact the frame-side supporting section 1852 in the movable range of the key 100, the key-side interference section 18571 and the frame-side supporting section 1852 contact each other in the flexible range of the rod-like flexible member 1850, as described above.

At this time, the key-side interference section 18571 has a shape protruding toward the frame-side supporting section 1852 from the pedestal 1857. Thus, an amount of use of a material can be more reduced than when the thickness of the entire pedestal 1857 is increased to make a distance between the frame-side supporting section 1852 and the pedestal 1857 closer to each other.

[Structures of Rod-Like Flexible Member, Key-Side Supporting Section, and Frame-Side Supporting Section]

Then, the rod-like flexible member 1850, the key-side supporting section 1851, and the frame-side supporting section 1852 in the rotating section 185 will be described.

Figure 10:
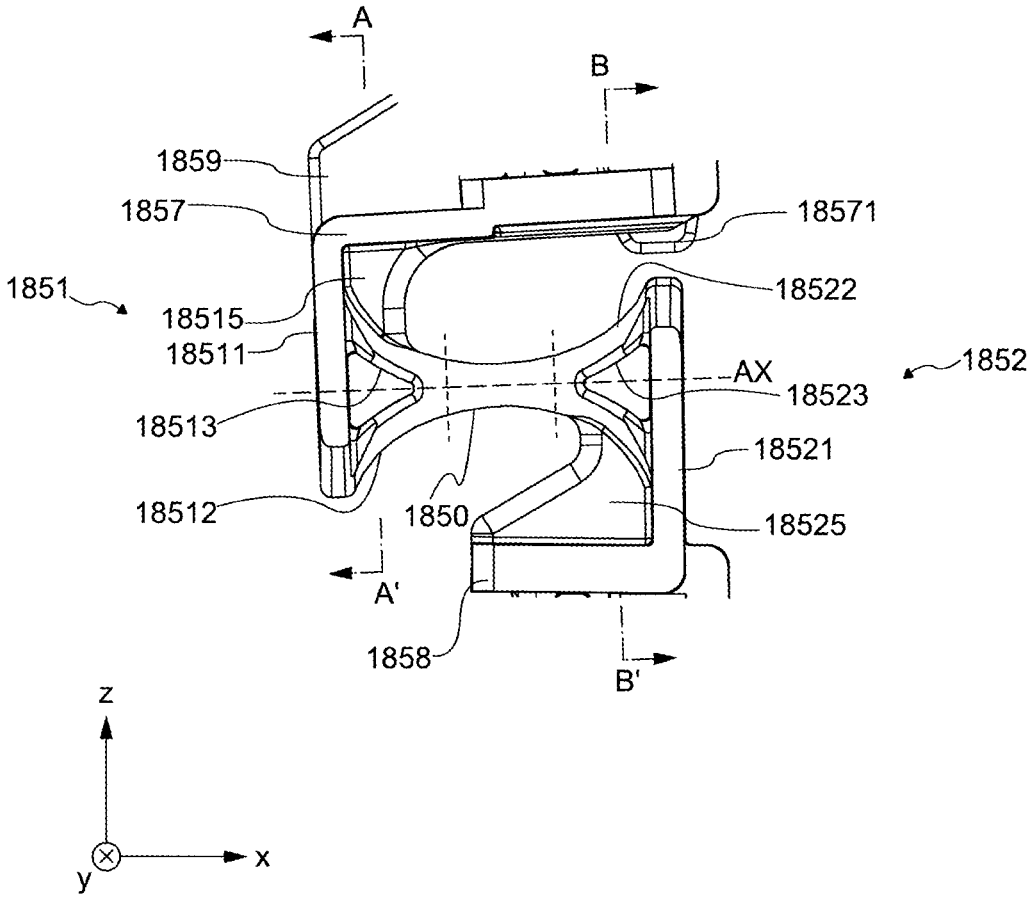
FIG. 10 is a diagram illustrating respective structures of a rod-like flexible member, a key-side supporting section, and a frame-side supporting section in the first embodiment.

FIG. 10 is a diagram illustrating respective structures of the rod-like flexible member 1850, the key-side supporting section 1851, and the frame-side supporting section 1852 in the first embodiment. FIG. 10 is a diagram illustrating a structure in the vicinity of the rod-like flexible member 1850 in the rotating section 185 in an enlarged manner. First, for convenience of illustration, respective directions with a main axis AX of the rod-like flexible member 1850 as a reference are defined in FIG. 10. The main axis AX corresponds to a longitudinal direction of the rod-like flexible member 1850 (a direction connecting both ends of the rod-like flexible member 1850), as described above. Here, an x direction is a direction along the main axis AX. A y direction corresponds to the scale direction S, and is in a relationship perpendicular to the x direction. A z direction is a direction perpendicular to both the x direction and the y direction. Since the main axis AX substantially corresponds to the front-to-back direction F, the z direction substantially corresponds to the up-and-down direction V.

Figure 11A:
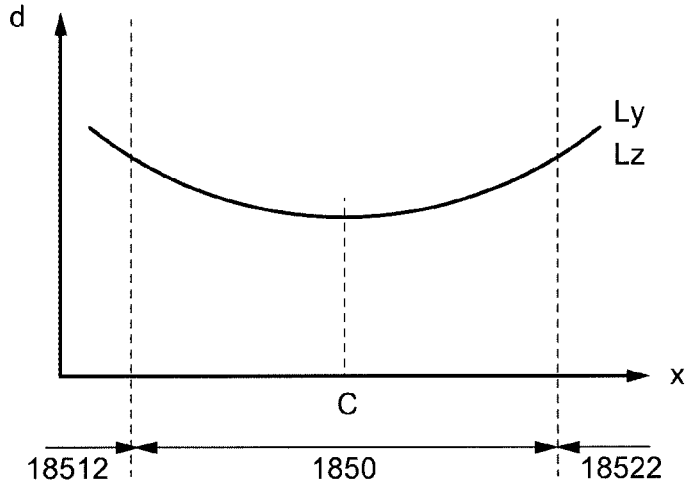
FIG. 11A is a diagram illustrating a cross-sectional shape of the rod-like flexible member in the first embodiment and illustrates a length in a y-direction and a length in a z-direction (a vertical axis d) at each position in an x-direction (a horizontal axis x) for a cross section perpendicular to the x-direction.
Figure 11B:
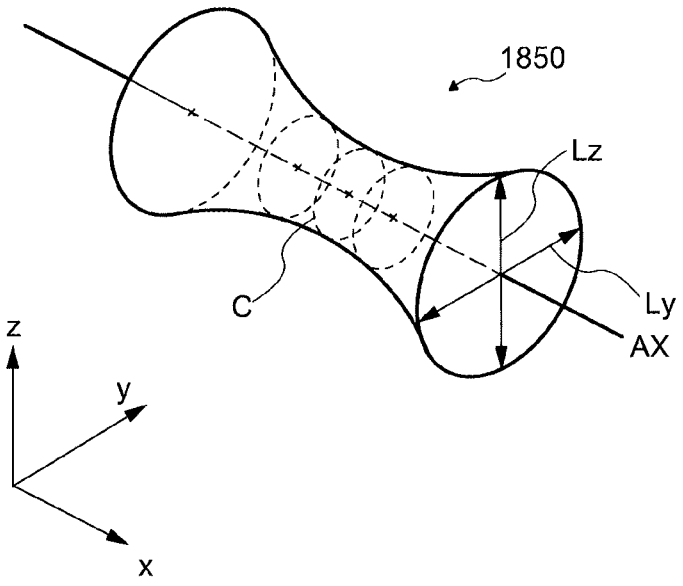
FIG. 11B is a diagram illustrating the cross-sectional shape of the rod-like flexible member in the first embodiment and illustrates the rod-like flexible member in perspective.

FIGS. 11A and 11B are diagrams each illustrating a cross-sectional shape of the rod-like flexible member 1850 in the first embodiment. FIG. 11A illustrates a length in the y direction and a length in the z direction (a longitudinal axis d) at each position in the x direction (a horizontal axis x) for a cross section perpendicular to the x direction. FIG. 11B illustrates the rod-like flexible member 1850 in perspective. In this example, since the rod-like flexible member 1850 has a shape of a rotating body having the main axis AX as an axis of rotation, its cross section has a circular outer edge. Therefore, the length in the y direction and the length in the z direction are the same. A change in length described below can also be replaced as a change in cross-sectional area. In a perspective view of the rod-like flexible member 1850, Ly corresponds to the length in the y direction, and Lz corresponds to the length in the z direction.

As illustrated in FIG. 11A, the rod-like flexible member 1850 has a position in the x direction at which its lengths Ly and Lz become shortest (hereinafter referred to as a minimum point C) in its cross section perpendicular to the main axis AX (the x direction), and includes a region where the lengths Ly and Lx continuously increase toward both its ends from the minimum point C. The minimum point C is a center in the longitudinal direction of the rod-like flexible member 1850 in this example. The rod-like flexible member 1850 can be bent and deformed in a direction other than the front-to-back direction F (other than a direction along the main axis AX) (two directions among three directions for respectively defining three dimensions) by having such a shape. Since the rod-like flexible member 1850 has a structure most easily bent at the minimum point C, a position of the rotation center can also be stabilized by various methods of key depression.

Referring to FIG. 10 again, description is continued. The key-side supporting section 1851 includes the supporting plate 18511, a bonding section 18512, recessed sections 18513, and a reinforcement plate 18515. Respective configurations will be described with reference to FIGS. 10 and 12.

Figure 12:
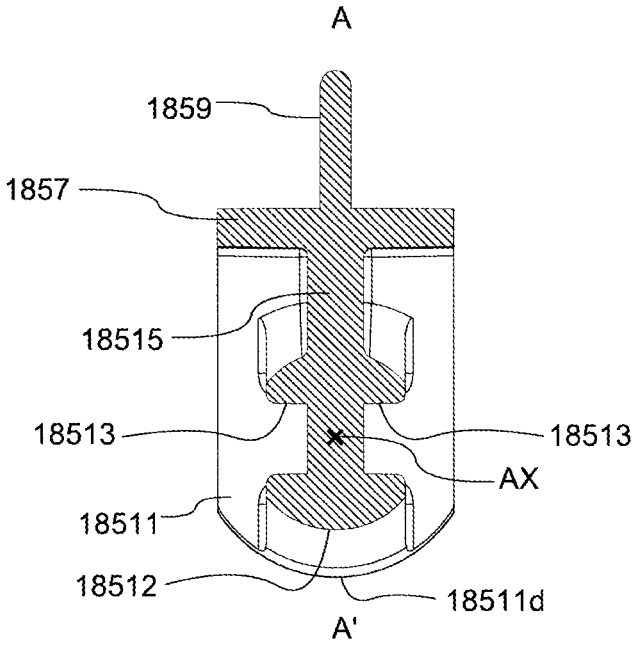
FIG. 12 is a diagram illustrating a cross-sectional shape of the key-side supporting section in the first embodiment.

FIG. 12 is a diagram illustrating a cross-sectional shape of the key-side supporting section 1851 in the first embodiment. The cross-sectional shape corresponds to a cross-sectional structure along a section line A-A' illustrated in FIG. 10. The supporting plate 18511 is a plate-like member spreading along a surface using a direction substantially along the main axis AX as a normal direction, and extends downward from the pedestal 1857. That is, the supporting plate 18511 extends downward with respect to the first supporting section 183. In this example, a lower end section **18511*d* in the supporting section 18511** has a shape of a circular arc. A center of the circular arc exists on the main axis AX.

The bonding section 18512 is a member for bonding the supporting plate 18511 and the rod-like flexible member 1850, its upper end portion and lower end portion respectively include shapes of circular arcs, and respective centers of the circular arcs exist on the main axis AX. This shape enables continuity with a shape of the rod-like flexible member 1850 to be kept. The continuity enables a stress occurring when the rod-like flexible member 1850 is deformed to be relaxed.

The recessed sections 18513 are respectively arranged on both side surfaces (two surfaces in the scale direction S) of the bonding section 18512. The existence of the recessed sections 18513 enables a stress occurring when the rod-like flexible member 1850 is deformed to be relaxed in a bonding section (the bonding section 18512) between the rod-like flexible member 1850 and the supporting plate 18511. Particularly, the rod-like flexible member 1850 is bent and deformed in the up-and-down direction V. On the other hand, the rod-like flexible member 1850 is hardly bent and deformed at the time of normal use (at the time of key depression), although it can be bent and deformed in the scale direction S. When the recessed sections 18513 are formed on the surfaces in the scale direction S in which no bending deformation occurs, a larger stress relaxation effect is obtained. An amount of use of a resin material used at the time of resin molding can also be reduced.

The reinforcement plate 18515 is a plate-like member spreading along a surface perpendicular to the pedestal 1857 and the supporting plate 18511, and is connected to the pedestal 1857, the supporting plate 18511, and the bonding section 18512. The existence of the reinforcement plate 18515 enables the rigidity of the entire key-side supporting section 1851 to be increased because a positional relationship among the pedestal 1857, the supporting plate 18511, and the bonding section 18512 does not easily change.

Referring to FIG. 10 again, description is continued. The frame-side supporting section 1852 includes the supporting plate 18521, a bonding section 18522, recessed sections 18523, and a reinforcement plate 18525. Respective configurations will be described with reference to FIGS. 10 and 13.

Figure 13:
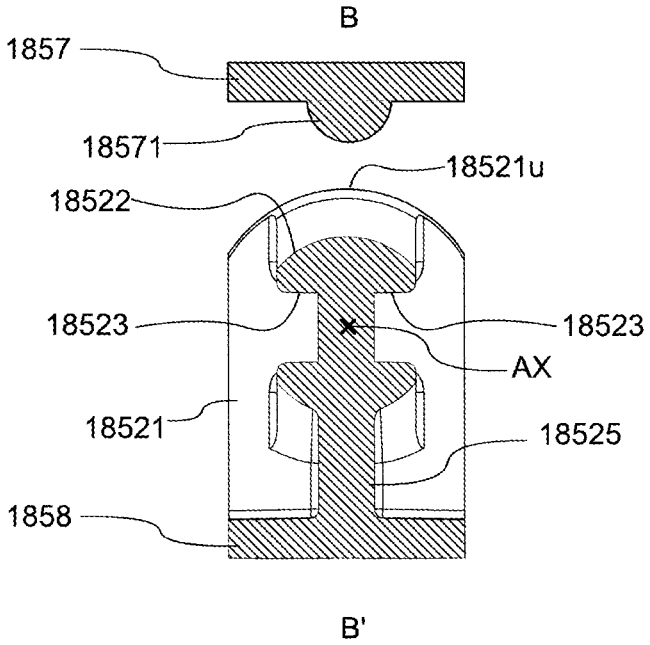
FIG. 13 is a diagram illustrating a cross-sectional shape of the frame-side supporting section in the first embodiment.

FIG. 13 is a diagram illustrating a cross-sectional shape of the frame-side supporting section 1852 in the first embodiment. The cross-sectional shape corresponds to a cross-sectional structure along a section line B-B' illustrated in FIG. 10. The supporting plate 18521 is a plate-like member spreading along a surface using a direction substantially along the main axis AX as a normal direction, and extends upward from the pedestal 1858. In this example, an upper end section 18521*u* in the supporting plate 18521 has a shape of a circular arc. A center of the circular arc exists on the main axis AX. The rotating section 185 having such a structure enables a distance between the supporting plate 18521 and the key-side interference section 18571 to be substantially constant even when the supporting plate 18521 rotates around the main axis AX when the rod-like flexible member 1850 is deformed to be twisted with respect to the main axis AX.

The bonding section 18522 is a member for bonding the supporting plate 18521 and the rod-like flexible member 1850, its upper end portion and lower end portion respectively include shapes of circular arcs, and respective centers of the circular arcs exist on the main axis AX. The shape enables continuity with a shape of the rod-like flexible member 1850 to be kept. The continuity enables a stress occurring when the rod-like flexible member 1850 is deformed to be relaxed.

The recessed sections 18523 are respectively arranged on both side surfaces (two surfaces in the scale direction S) of the bonding section 18522. The existence of the recessed sections 18523 enables a stress occurring when the rod-like flexible member 1850 is deformed to be relaxed in a bonding section (the bonding section 18522) between the rod-like flexible member 1850 and the supporting plate 18521. An amount of use of a resin material used at the time of resin molding can also be reduced.

The reinforcement plate 18525 is a plate-like member spreading along a surface perpendicular to the pedestal 1858 and the supporting plate 18521, and is connected to the pedestal 1858, the supporting plate 18521, and the bonding section 18522. The existence of the reinforcement plate 18525 enables the rigidity of the entire frame-side supporting section 1852 to be increased because a positional relationship among the pedestal 1858, the supporting plate 18521, and the bonding section 18522 does not easily change.

[Operation of Keyboard Assembly]

Figure 14A:
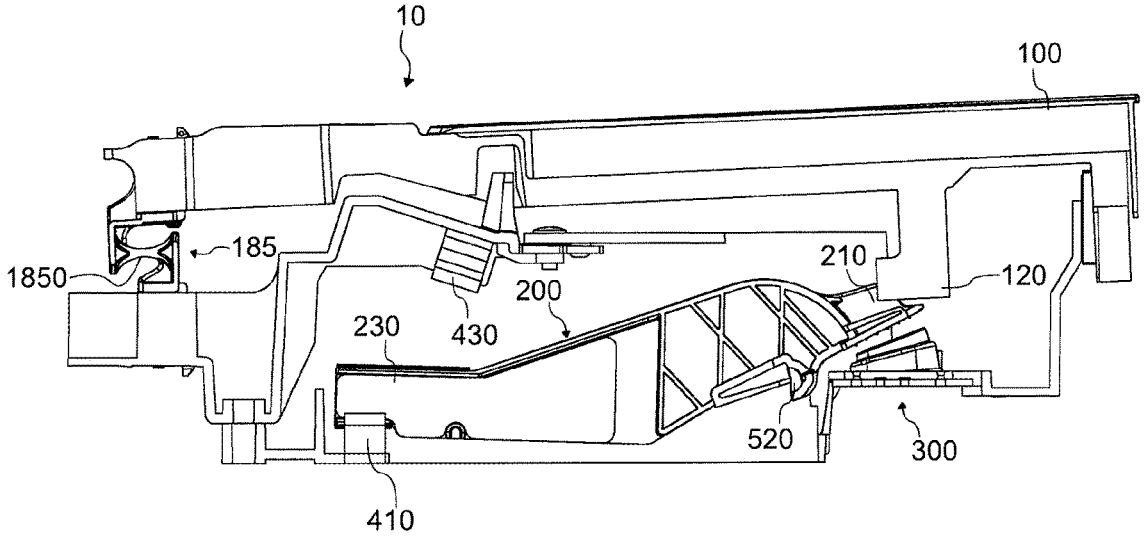
FIG. 14A is a diagram illustrating an operation of a key assembly in a case where a key (white key) is depressed in the first embodiment and is a diagram in a case where the key is at a rest position (remains not depressed)
Figure 14B:
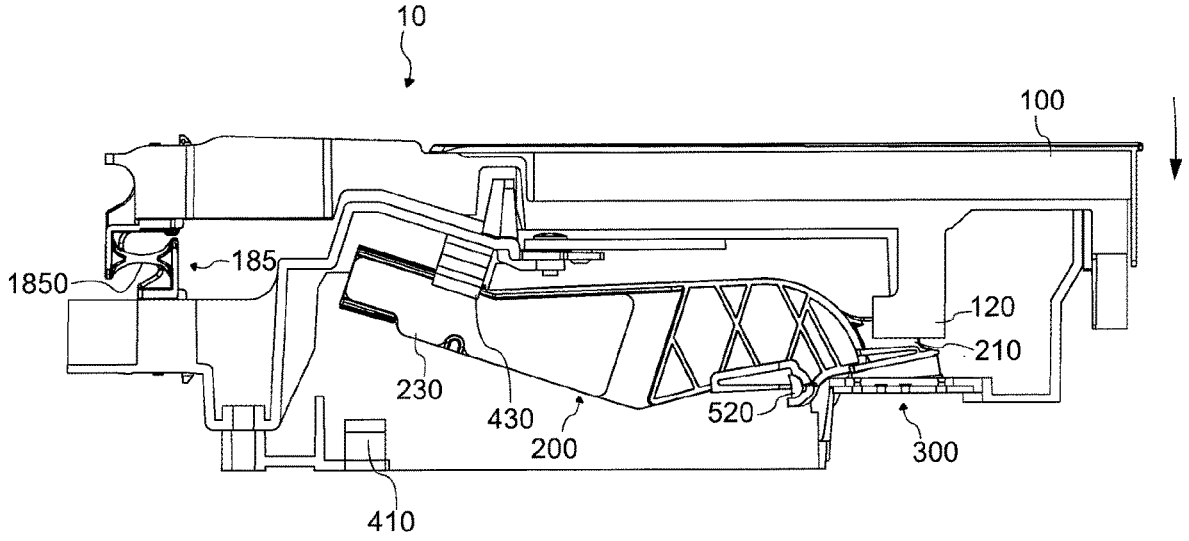
FIG. 14B is a diagram illustrating an operation of the key assembly in a case where the key (white key) is depressed in the first embodiment and is a diagram in a case where the key is at an end position (remains depressed to the end)

FIGS. 14A and 14B are diagrams each illustrating an operation of the key assembly 10 in a case where the key (white key) 100 is depressed in the first embodiment. FIG. 14A is a diagram in a case where the key 100 is at a rest position (remains not depressed). FIG. 14B is a diagram in a case where the key 100 is at an end position (remains depressed to the end). When the key 100 is depressed, the rotating section 185, specifically the rod-like flexible member 1850, is bent as a rotation center. At this time, the rod-like flexible member 1850, is bent and deformed in the up-and-down direction V without being almost deformed in the front-to-back direction F. As a result, the key 100 rotates in the pitch direction. When the hammer supporting section 120 presses the front end section 210 down, the hammer assembly 200 rotates around the shaft 520. When the weight section 230 collides with the upper stopper 430, the hammer assembly 200 stops rotating, and the key 100 reaches the end position. When the sensor 300 is deformed by the front end section 210, the sensor 300 outputs a detection signal in a plurality of stages corresponding to a deformation amount (a key depression amount).

On the other hand, when the key 100 is released, the weight section 230 moves downward, the hammer assembly 200 rotates, and the key 100 rotates upward. When the weight section 230 contacts the lower stopper 410, the hammer assembly 200 stops rotating, and the key 100 returns to the rest position.

Second Embodiment

In the first embodiment, the key-side interference section 18571 is provided to restrict a deformation amount of the rod-like flexible member 1850 when the rotating section 185 is attached to the first supporting section 183 and the second supporting section 585. In a second embodiment, a rotating section 185A having a configuration in which a deformation amount of a rod-like flexible member 1850 is restricted when the rotating section 185A is detached from a first supporting section 183 and a second supporting section 585 will be described.

Figure 15:
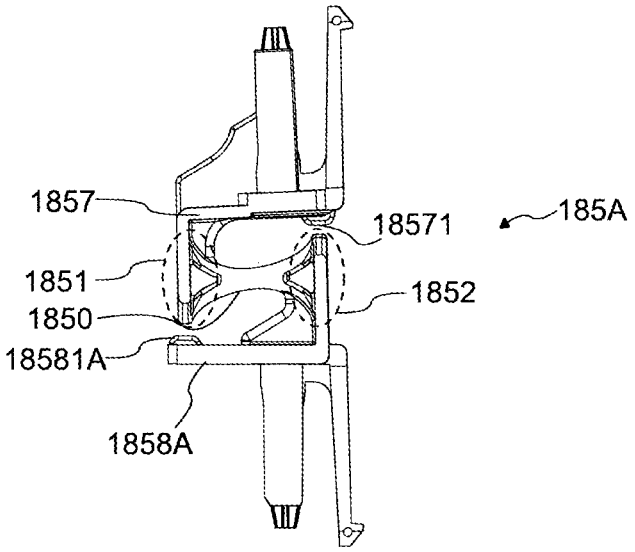
FIG. 15 is a diagram illustrating a structure of a rotating section in a second embodiment.

FIG. 15 is a diagram illustrating a structure of the rotating section 185A in the second embodiment. The rotating section 185A includes a pedestal 1858A extending to the deeper side than the rotating section 185 in the first embodiment and a frame-side interference section 18581A connected to the pedestal 1858A. The frame-side interference section 18581A is connected to the pedestal 1858A at a position opposing the key-side supporting section 1851. The frame-side interference section 18581A is arranged with its positional relationship fixed to a frame-side supporting section 1852 via the pedestal 1858A. When the rod-like flexible member 1850 is bent in an up-and-down direction, the frame-side interference section 18581A and the key-side supporting section 1851 contact each other. The frame-side interference section 18581A and the key-side supporting section 1851 are prevented from contacting each other by depression of a key 100. This is because the frame-side interference section 18581A and the key-side supporting section 1851 move in a direction away from each other by depression of the key 100. That is, a positional relationship between the frame-side interference section 18581A and the key-side supporting section 1851 is determined such that the frame-side interference section 18581A and the key-side supporting section 1851 contact each other outside a movable range of the key 100 and in a flexible range of the rod-like flexible member 1850.

The key-side interference section 18571 is used to restrict a deformation of the rod-like flexible member 1850 when the rotating section 185 is attached to the first supporting section 183 and the second supporting section 585, as described above. On the other hand, the frame-side interference section 18581A is used to restrict a deformation of the rod-like flexible member 1850 when the rotating section 185A is detached from the first supporting section 183 and the second supporting section 585.

When the rotating section 185A is detached from the first supporting section 183 and the second supporting section 585, pressure is applied such that a pedestal 1857 and the pedestal 1858A move away from each other. As a result, a force is applied such that the key-side supporting section 1851 moves upward and the frame-side supporting section 1852 moves downward. Thus, the force is exerted to deform the rod-like flexible member 1850. Depending on a working situation, the force may be applied such that the pedestal 1857 and the pedestal 1858A move away from each other in an up-and-down direction toward the front side thereof (toward the side of a front end of the key 100). In such a case, the rod-like flexible member 1850 is deformed in a direction in which the frame-side interference section 18581A and the key-side supporting section 1851 (more specifically, a supporting plate 18511 illustrated in FIG. 10) contact each other. When the frame-side interference section 18581A and the key-side supporting section 1851 contact each other, the pedestal 1857 and the pedestal 1858A cannot come any closer to each other. Therefore, the deformation of the rod-like flexible member 1850 can be inhibited from increasing.

Third Embodiment

In the first embodiment, the key-side supporting section 1851 is arranged on the deeper side than the frame-side supporting section 1852. In a third embodiment, a rotating section 185B in which a positional relationship between a key-side supporting section 1851B and a frame-side supporting section 1852B is opposite to that in the first embodiment will be described.

Figure 16:
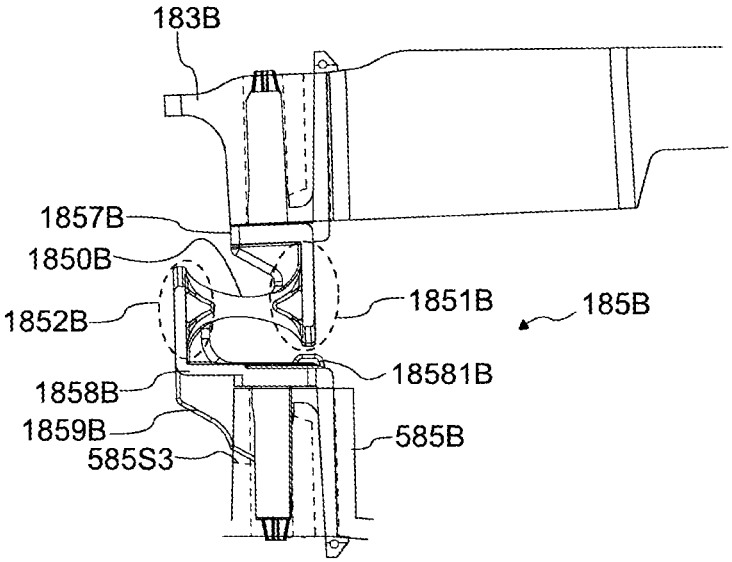
FIG. 16 is a diagram illustrating a structure of a rotating section in a third embodiment.

FIG. 16 is a diagram illustrating a structure of the rotating section 185B in the third embodiment. The rotating section 185B is connected to a first supporting section 183B and a second supporting section 585B by substantially reversing the rotating section 185 in the first embodiment up and down. In this structure, a position of a rod-like flexible member 1850B is the same as that in the first embodiment. The frame-side supporting section 1852B is arranged on the deeper side than the key-side supporting section 1851B. A frame-side interference section 18581B is arranged in place of the key-side interference section 18571. The frame-side supporting section 1852B exists on the further deeper side than second supporting section 585B. Therefore, to inhibit a pedestal 1858B to which the frame-side supporting section 1852B is connected from being deformed, a reinforcement plate 1859B is connected to the pedestal 1858B. A third space 585S3 which is to pass through the reinforcement plate 1859B is formed in the second supporting section 585B. Contrary to this, in this example, a third space 183S3 is not formed in the first supporting section 183B.

In the rotating section 185 in the first embodiment, a space spreading to the vicinity of the rod-like flexible member 1850 can be ensured on the side of a rear end of the frame 500 (the second supporting section 585). On the other hand, the key-side supporting section 1851 moves by key depression. Accordingly, if any structure is arranged in this space, a predetermined margin needs to be ensured such that the structure does not contact the key-side supporting section 1851 to suppress an influence on a touch feeling.

In the rotating section 185B in the third embodiment, the frame-side supporting section 1852B exists in a region close to the side of a rear end of a frame 500 (the second supporting section 585B). Thus, a narrower space than that in the first embodiment is ensured. On the other hand, while the key-side supporting section 1851B moves by key depression, the frame-side supporting section 1852B hardly moves. Accordingly, when any structure is arranged in this space, even if the structure temporarily contacts the frame-side supporting section 1852B, a touch feeling is hardly affected. Which of the structure in the first embodiment and the structure in the third embodiment is to be adopted may be appropriately selected depending on a content of a design.

Fourth Embodiment

Although the rod-like flexible member 1850 is a rotating body having the main axis AX as an axis of rotation, and its cross section is circular in the above-described embodiment, the rod-like flexible member 1850 may have an outer edge including a curved line to be other than a circle in cross section if it has a structure which can be bent and deformed in the up-and-down direction V. In a fourth embodiment, a rod-like flexible member 1850C having an elliptical shape in cross section will be described.

Figure 17A:
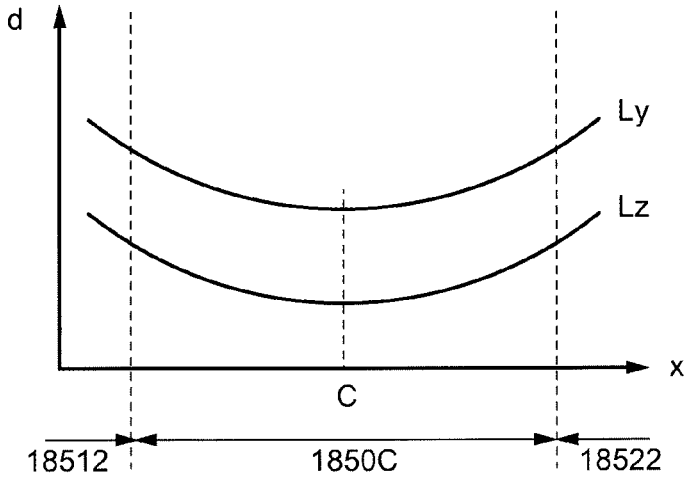
FIG. 17A is a diagram illustrating a cross-sectional shape of a rod-like flexible member in a fourth embodiment and is a diagram corresponding to FIG. 11A.
Figure 17B:
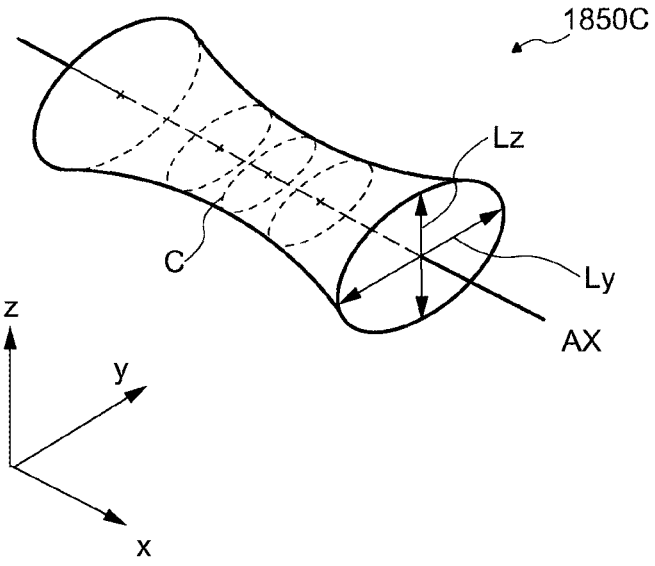
FIG. 17B is a diagram illustrating a cross-sectional shape of the rod-like flexible member in the fourth embodiment and is a diagram corresponding to FIG. 11B.

FIGS. 17A and 17B are diagrams each illustrating a cross-sectional shape of the rod-like flexible member 1850C in the fourth embodiment. FIG. 17A is a diagram corresponding to FIG. 11A, and FIG. 17B is a diagram corresponding to FIG. 11B. In this example, the rod-like flexible member 1850C has a trapezoidal cross section having a main axis AX as its center of gravity, and has a short axis in a z direction and a long axis in a y direction. That is, a length Lz is smaller than a length Ly. The rod-like flexible member 1850C includes a region where the length Ly and the length Lz in the cross section continuously increase toward both its ends from a minimum point C.

Fifth Embodiment

Although the rod-like flexible member 1850 is a rotating body having the main axis AX as an axis of rotation, and has a configuration in which the length in the y direction and the length in the z direction in the cross section continuously increase toward both the ends in the above-described embodiment, one or both of the length in the y direction and the length in the z direction may not change. When both the length in the y direction and the length in the z direction do not change, the thickness of the rod-like flexible member 1850 is uniform. In a fifth embodiment, a rod-like flexible member 1850D a length in a y direction in its cross section of which is constant will be described.

Figure 18A:
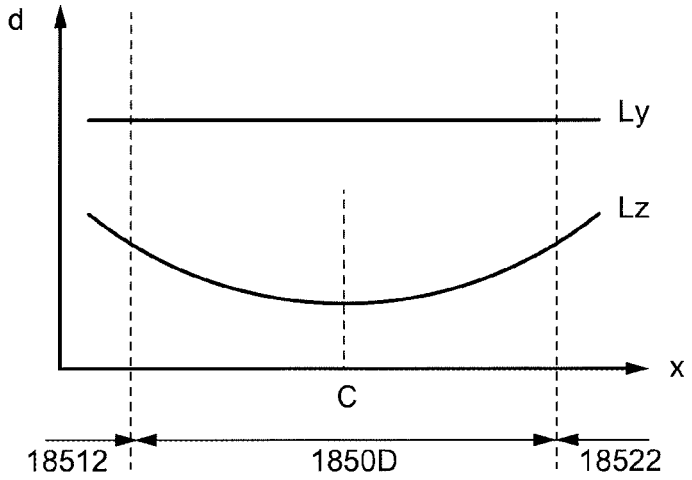
FIG. 18A is a diagram illustrating a cross-sectional shape of a rod-like flexible member in a fifth embodiment and is a diagram corresponding to FIG. 11A.
Figure 18B:
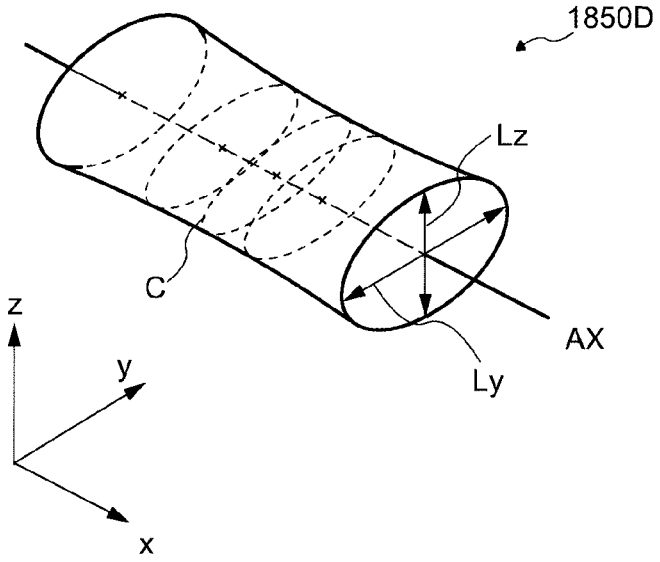
FIG. 18B is a diagram illustrating a cross-sectional shape of the rod-like flexible member in the fifth embodiment and is a diagram corresponding to FIG. 11B.

FIGS. 18A and 18B are diagrams each illustrating a cross-sectional shape of the rod-like flexible member 1850D in the fifth embodiment. FIG. 18A is a diagram corresponding to FIG. 11A, and FIG. 18B is a diagram corresponding to FIG. 11B. In this example, the rod-like flexible member 1850D has a trapezoidal cross section having a main axis AX as its center of gravity, and has a short axis in a z direction and a long axis in a y direction. The rod-like flexible member 1850D includes a region where a length Lz continuously increases toward both its ends from a minimum point C. On the other hand, a length Ly is a length which is constant at any position in an x direction.

If the length Lz in the cross section changes with respect to a position in the cross section in the x direction, as described above, the rod-like flexible member 1850D is easily bent in an up-and-down direction around the vicinity of the minimum point C when made to have the minimum point C. Thus, a position of a rotation center can be stabilized.

<Modification>

The above-described embodiments can be applied by being combined with and replaced with one another. The above-described embodiments can be implemented by being deformed, as described below.

(1) Although the rod-like flexible member 1850 has the outer edge having a circular shape in cross section perpendicular to the main axis AX in the first embodiment, the rod-like flexible member 1850 may have an outer edge including an angle. At this time, the rod-like flexible member 1850 may have an outer edge including a straight line in cross section.

Figure 19A:
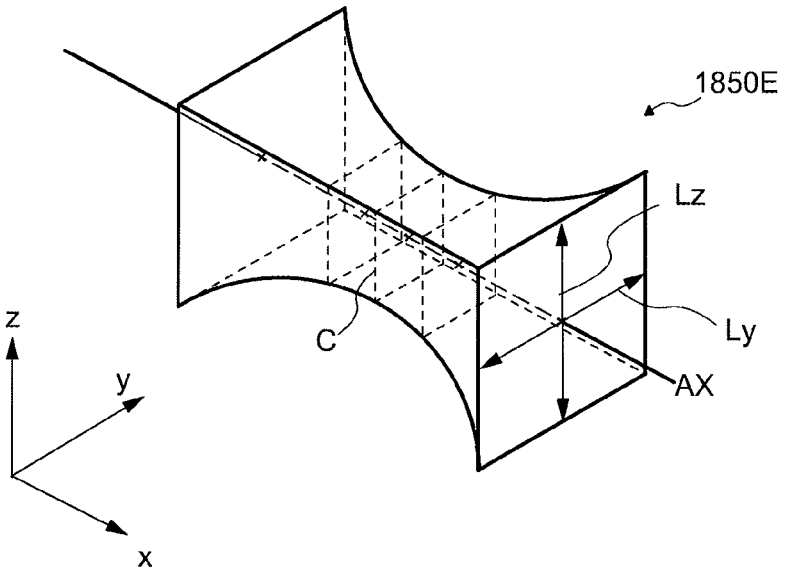
FIG. 19A is a diagram illustrating a cross-sectional shape of a rod-like flexible member in a modification (1) and illustrates an example in which the cross-sectional shape of the rod-like flexible member is made not circular but square in the first embodiment.
Figure 19B:
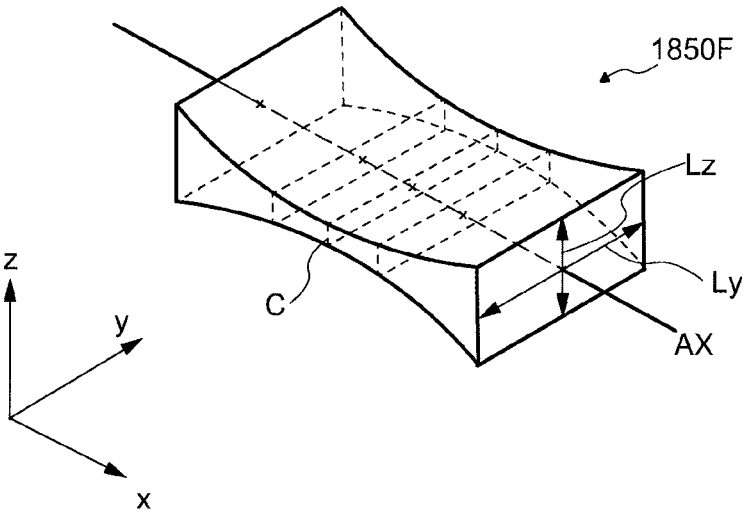
FIG. 19B is a diagram illustrating a cross-sectional shape of the rod-like flexible member in the modification (1) and illustrates an example in which the cross-sectional shape of the rod-like flexible member is made not circular but square in the fifth embodiment.

FIGS. 19A and 19B are diagrams each illustrating a cross-sectional shape of a rod-like flexible member 1850E in a modification (1). The rod-like flexible member 1850E illustrated in FIG. 19A is an example in which the cross-sectional shape of the rod-like flexible member 1850 in the first embodiment is changed to not a circular shape but a square shape. A rod-like flexible member 1850F illustrated in FIG. 19B is an example in which the cross-sectional shape of the rod-like flexible member 1850D in the fifth embodiment is changed to not a trapezoidal shape but a rectangular shape. For an example in which the cross-sectional shape of the rod-like flexible member 1850C in the fourth embodiment is changed to not a trapezoidal shape but a rectangular shape, a length Lz is only made smaller than a length Ly in FIG. 19A, and thus illustration thereof is omitted. In either structure, the rod-like flexible member may be able to be bent and deformed in an up-and-down direction V (z direction).

(2) Although the rod-like flexible member 1850 has the minimum point C at which the lengths Ly and Lz become shortest in the cross section perpendicular to the main axis AX in the first embodiment, a flexible member which can be bent in an up-and-down direction may not have a minimum point C. For example, the flexible member may have a range in which a portion where its length Lz becomes shortest is constant. At this time, the flexible member may further have a range in which a portion where its length Ly becomes shortest is similarly constant.

Figure 20A:
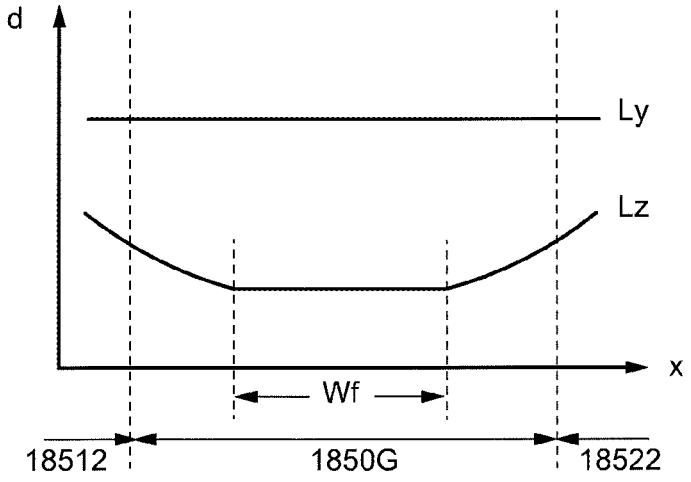
FIG. 20A is a diagram illustrating a cross-sectional shape of a rod-like flexible member in a modification (2) and is a diagram corresponding to FIG. 11A.
Figure 20B:
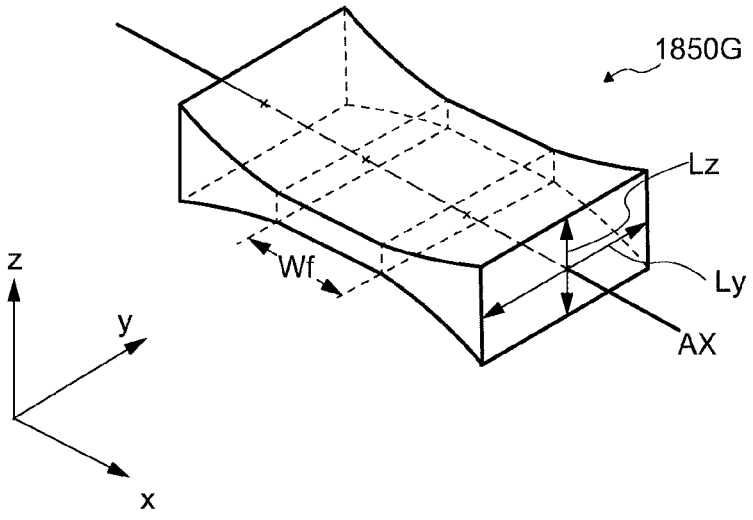
FIG. 20B is a diagram illustrating a cross-sectional shape of the rod-like flexible member in the modification (2) and is a diagram corresponding to FIG. 11B.

FIGS. 20A and 20B are diagrams each illustrating a cross-sectional shape of a rod-like flexible member 1850G in a modification (2). FIG. 20A is a diagram corresponding to FIG. 11A, and FIG. 20B is a diagram corresponding to FIG. 11B. The rod-like flexible member 1850G illustrated in FIG. 20 is an example in which its length Lz becomes a constant value in a partial range Wf for the rod-like flexible member 1850F illustrated in FIG. 19B, described above. The range Wf can be said to have a flat plate shape. That is, a shape of a portion bent and deformed by key depression is not limited to a rod shape. The length Lz may not only continue to change in all regions but also change in only some of the regions. In either case, flexible members having various shapes can be used if they can be bent in an up-and-down direction.

(3) Although the rod-like flexible member 1850 includes the region where the length Ly and the length Lz in the cross section continuously increase toward both the ends from the minimum point C in the first embodiment, the rod-like flexible member 1850 may not include the region where the lengths thus continuously increase. In this case, the rotating section 185 implements the rotation of the key 100 using a flexible member in a columnar shape (e.g., a column) the thickness of which is uniform or a plate shape (a flat plate) the thickness and the width of which are uniform.

(4) Although the rotating section 185 is detachably attached to the first supporting section 183 and the second supporting section 585 in the first embodiment, the rotating section 185 may not be detachably attachable to either one or both of the supporting sections. Even in a configuration in which the rotating section 185 is not detachably attachable to either one or both of the first supporting section 183 and the second supporting section 585, the key-side supporting section 1851 (the supporting plate 18511) is arranged on the side closer to the frame 500 (the second supporting section 585) than the key 100. On the other hand, the frame-side supporting section 1852 may be not only arranged on the side closer to the key 100 than the frame 500 (the second supporting section 585) but also arranged on the deeper side than the frame 500. In either case, the rod-like flexible member 1850 may be arranged below the key 100, that is, the rod-like flexible member 1850 may be arranged on the side closer to the frame 500 than the key 100.

(5) Although the rod-like flexible member 1850 is in the shape having the longitudinal direction in the first embodiment, the rod-like flexible member 1850 may not have a longitudinal direction or may have a longitudinal direction in the y direction if it has flexibility in the up-and-down direction V.

(6) Although the rod-like flexible member 1850 has the main axis AX (the longitudinal direction) substantially along the front-to-back direction F in the first embodiment, the rod-like flexible member 1850 may have a main axis AX inclined to the front-to-back direction F, i.e., may have a main axis AX along a direction closer to a depression direction of the key 100 (the up-and-down direction V) within a range where it can be bent and deformed in the up-and-down direction V.

REFERENCE SIGNS LIST

1 . . . keyboard apparatus, 10 . . . keyboard assembly, 70 . . . sound source device, 80 . . . speaker, 90 . . . housing, 100 . . . key, 100*w* . . . white key, 100*b* . . . black key, 120 . . . hammer supporting section, 151 . . . front end key guide, 151*u* . . . upper key guide, 151*d* . . . lower key guide, 153 . . . side key guide, 180 . . . connecting section, 181, 181*w*, 181*b* . . . plate-like flexible member, 183, 183*w*, 183*b*, 183B . . . first supporting section, 183S1 . . . first space, 183S2 . . . second space, 183S . . . third space, 185, 185A, 185B . . . rotating section, 1850, 1850B, 1850C, 1850D, 1850E, 1850F, 1850G . . . rod-like flexible member, 1851, 1851B . . . key-side supporting section, 18511 . . . supporting plate, 18511*d* . . . lower end section, 18512 . . . bonding section, 18513 . . . recessed section, 18515 . . . reinforcement plate, 1852,1852B . . . frame-side supporting section, 18521 . . . supporting plate, 18521*u* . . . upper end section, 18522 . . . bonding section, 18523 . . . recessed section, 18525 . . . reinforcement plate, 1853 . . . supporting rod, 1854 . . . supporting rod, 1855 . . . engaging rod, 1856 . . . engaging rod, 18551 . . . engaging section, 18561 . . . engaging section, 1857 . . . pedestal, 18571 . . . key-side interference section, 1858, 1858A, 1858B . . . pedestal, 18581A . . . frame-side interference section, 1859, 1859B . . . reinforcement plate, 200 . . . hammer assembly, 210 . . . front end section, 220 . . . bearing section, 230 . . . weight section, 300 . . . sensor, 410 . . . lower stopper, 430 . . . upper stopper, 500 . . . frame, 511 . . . front-end frame guide, 513 . . . side frame guide, 520 . . . shaft, 585, 585*w*, 585*b*, 585B . . . second supporting section, 585S1 . . . first space, 585S2 . . . second space, 585S3 . . . third space, 590 . . . supporting column, 710 . . . signal converting unit, 730 . . . sound source unit, 750 . . . output unit

The invention claimed is:

1. A keyboard apparatus comprising:

a key configured to rotate;

a member fixed to the key such that a positional relationship between the member and the key does not change when the key rotates;

a frame arranged below the key;

a key-side supporting section connected to the member fixed to the key and extending more downward than the member; and a flexible section supported by the key-side supporting section, having flexibility in at least an up-and-down direction, and configured to rotate the key with respect to the frame, wherein the flexible section has a longitudinal direction and has an outer edge including a curved line in a cross section perpendicular to the longitudinal direction.

2. The keyboard apparatus according to claim 1, wherein the flexible section includes a region where a length of the flexible section in a direction perpendicular to a scale direction increases toward both ends of the flexible section in the cross section perpendicular to the longitudinal direction.

3. The keyboard apparatus according to claim 1, further comprising:

a member fixed to the frame; and a frame-side supporting section connected to the member fixed to the frame and extending more upward than the member fixed to the frame, wherein the frame-side supporting section and the key-side supporting section support opposite sides of the flexible section from each other.

4. The keyboard apparatus according to claim 3, wherein the frame-side supporting section is arranged between a front end of the key and the key-side supporting section.

5. The keyboard apparatus according to claim 3, wherein the key-side supporting section is arranged between a front end of the key and the frame-side supporting section.

6. The keyboard apparatus according to claim 3, wherein the flexible section is detachably attached to at least one of the key and the frame.

7. The keyboard apparatus according to claim 6, further comprising a key-side interference section fixed to the key-side supporting section, the key-side interference section configured to contact the frame-side supporting section outside a movable range of the key and in a flexible range of the flexible section.

8. The keyboard apparatus according to claim 6, further comprising a frame-side interference section fixed to the frame-side supporting section, the frame-side interference section configured to contact the key-side supporting section outside a movable range of the key and in a flexible range of the flexible section.

9. A keyboard apparatus comprising:

a key configured to rotate;

a member fixed to the key such that a positional relationship between the member and the key does not change when the key rotates;

a frame arranged below the key;

a key-side supporting section connected to the member fixed to the key and extending more downward than the member; and a flexible section supported by the key-side supporting section, having flexibility in at least an up-and-down direction, and configured to rotate the key with respect to the frame, wherein the flexible section has a longitudinal direction and has an outer edge including an angle in a cross section perpendicular to the longitudinal direction.

10. The keyboard apparatus according to claim 9, wherein the flexible section includes a region where a length of the flexible section in a direction perpendicular to a scale direction increases toward both ends of the flexible section in the cross section perpendicular to the longitudinal direction.

11. The keyboard apparatus according to claim 9, further comprising:

a member fixed to the frame; and a frame-side supporting section connected to the member fixed to the frame and extending more upward than the member fixed to the frame, wherein the frame-side supporting section and the key-side supporting section support opposite sides of the flexible section from each other.

12. The keyboard apparatus according to claim 11, wherein the frame-side supporting section is arranged between a front end of the key and the key-side supporting section.

13. The keyboard apparatus according to claim 11, wherein the key-side supporting section is arranged between a front end of the key and the frame-side supporting section.

14. The keyboard apparatus according to claim 11, wherein the flexible section is detachably attached to at least one of the key and the frame.

15. The keyboard apparatus according to claim 14, further comprising a key-side interference section fixed to the key-side supporting section, the key-side interference section configured to contact the frame-side supporting section outside a movable range of the key and in a flexible range of the flexible section.

16. The keyboard apparatus according to claim 14, further comprising a frame-side interference section fixed to the frame-side supporting section, the frame-side interference section configured to contact the key-side supporting section outside a movable range of the key and in a flexible range of the flexible section.

* * * * *